US012687079B1

(12) United States Patent
Legendre, III et al.

(10) Patent No.: US 12,687,079 B1
(45) Date of Patent: Jul. 21, 2026

(54) WIRELINE SETTING ASSEMBLY

(71) Applicant: Halliburton Energy Services, Inc., Houston, TX (US)

(72) Inventors: Oneil J. Legendre, III, Luling, LA (US); Bryant J. Hebert, Jr., Houma, LA (US)

(73) Assignee: Wellbore Solutions, Inc., Lockport, LA (US)

( * ) Notice: Subject to any disclaimer, the term of this patent is extended or adjusted under 35 U.S.C. 154(b) by 0 days.

(21) Appl. No.: 18/612,294

(22) Filed: Mar. 21, 2024

Related U.S. Application Data

(60) Provisional application No. 63/453,737, filed on Mar. 21, 2023.

(51) Int. Cl.
*E21B 23/04* (2006.01)

(52) U.S. Cl.
CPC ..... *E21B 23/0414* (2020.05); *E21B 23/042* (2020.05)

(58) Field of Classification Search
CPC ..... E21B 23/0414; E21B 23/042
See application file for complete search history.

(56) References Cited

U.S. PATENT DOCUMENTS

2007/0089911 A1* 4/2007 Moyes ..... E21B 7/007 175/93
2019/0330945 A1* 10/2019 Rosenthal ..... E21B 23/0412
2019/0368293 A1* 12/2019 Covalt ..... E21B 33/128
2022/0127919 A1* 4/2022 Gleason ..... E21B 23/042

* cited by examiner

*Primary Examiner* — Nicole Coy
*Assistant Examiner* — Jennifer A Railey
(74) *Attorney, Agent, or Firm* — Taylor M. Norton; Norton IP Law Firm LLC

(57) ABSTRACT

A wireline setting assembly for engaging oil and gas downhole tools is provided. The setting assembly has a piston inside a cylinder and allows annular fluid to flow into an internal cavity. Pressure in an upper chamber of the cylinder causing motion of the piston is resisted by annular fluid flowing out of the internal cavity through an orifice, thereby creating a smooth motion of the piston. The pressure is automatically released through the orifice when the piston head reaches a lower cylinder chamber having a wider diameter than the piston head, allowing pressure to flow from the upper chamber into the lower chamber and out of the orifice.

29 Claims, 26 Drawing Sheets

WIRELINE SETTING ASSEMBLY

CROSS-REFERENCE TO RELATED APPLICATIONS

This application claims priority from U.S. Provisional Application No. 63,453,737, filed Mar. 21, 2023, which is incorporated by reference as if set forth in full below.

BACKGROUND OF THE INVENTION

The present invention relates to the field of oil and gas downhole tools. More specifically, the present invention relates to an apparatus that is placed downhole and which can be remotely engaged to apply force to a tool in order to cause an action of that tool. In some embodiments, the present invention may be used to engage a packer, plug, or other tool following American Petroleum Institute Standard 11D1.

SUMMARY OF THE INVENTION

One general aspect of the invention includes a wireline setting assembly for engaging a downhole tool a cylinder. The wireline setting assembly also includes where said cylinder may include a cylinder wall, at least one orifice, and an internal cavity may include an upper chamber and a lower chamber; where said at least one orifice provides an opening between said lower chamber and an exterior of said cylinder; where said piston may include a piston head, a piston body, a piston bottom end, and a crosslink receptacle; where said mandrel may include a mandrel cavity, a first mandrel crosslink slot, and a second mandrel crosslink slot; where said first mandrel crosslink slot and said second mandrel crosslink slot each extend along an axial length of said mandrel; where said sleeve adapter may include a sleeve adapter cavity, a first sleeve adapter crosslink slot, and a second sleeve adapter crosslink slot; where said mandrel is within said sleeve adapter cavity; where a bottom end of said cylinder is removably fastened to a top end of said mandrel; where said piston head forms an airtight seal against an inner wall of said lower chamber; where said crosslink affixes said sleeve adapter to said piston by extending through said first sleeve adapter crosslink slot, said second sleeve adapter crosslink slot, and said crosslink receptacle; where said crosslink slidably affixes said piston and said sleeve adapter to said mandrel by extending through said first mandrel crosslink slot and said second mandrel crosslink slot; where said crosslink, said piston, and said sleeve adapter are configured to engage in a sliding motion along said axial length; where motion of said piston along said axial length results in said piston head moving between a first location in said lower chamber and a second location in said lower chamber.

Various embodiments may include one or more of the following features. The wireline setting assembly may include an annular fluid cavity between said piston body and said cylinder wall in said lower chamber, and where said wireline setting assembly is configured to allow annular fluid to fill said annular fluid cavity when said wireline setting assembly is submerged in said annular fluid. Said wireline setting assembly is configured to engage in said sliding motion in response to pressure in said upper chamber. When said annular fluid is in said annular fluid cavity, flow of said annular fluid out of said annular fluid cavity through said at least one orifice causes a resistance against said sliding motion. Said pressure is released through said at least one orifice when said piston head moves to said second location. Said lower chamber has a first inner diameter at said first location and said lower chamber has a second inner diameter at said second location, where said second inner diameter is larger than said first inner diameter, and where said airtight seal becomes disengaged when said piston head moves to said second location. Said pressure is created by a setting charge producing charge gas that flows into said upper chamber. Each said at least one orifice is configured to receive an orifice plug and each said orifice plug further may include an orifice plug tube. Decreasing a size of each said orifice plug tube increases said resistance. Said at least one orifice is two orifices and each said orifice plug tube has a diameter of between approximately 0.010 and 0.055 inches. Said sleeve adapter is configured to removably attach to a setting sleeve and said mandrel is configured to removably attach to a tool adapter; where said sliding motion along said axial length causes relative motion of said sleeve adapter and said tool adapter; where said wireline setting adapter is configured to cause engagement of said downhole tool in response to said relative motion.

One general aspect includes a wireline setting assembly for engaging a downhole tool a cylinder and a piston. The wireline setting assembly also includes where said cylinder may include a cylinder wall, at least one orifice, and an internal cavity may include an upper chamber and a lower chamber; where said at least one orifice provides an opening between said lower chamber and an exterior of said cylinder; where said piston may include a piston head and a piston body; where said piston head is inside said internal cavity and forms an airtight seal against said lower chamber; where said piston body and said cylinder wall form an annular fluid cavity; where, when said annular fluid cavity is filled with an annular fluid, motion of said piston head from a top end of said lower chamber towards a bottom end of said lower chamber causes flow of said annular fluid out of said at least one orifice.

Various embodiments may include one or more of the following features. The wireline setting assembly may include a means for engaging said downhole tool in response to said motion. A pressure in said upper chamber causes said motion of said piston head. Said pressure is released through said orifice when said piston head moves into said lower chamber. Said wireline setting assembly is configured to fully engage in between approximately 10 to 300 seconds when a setting charge is detonated.

One general aspect includes a cylinder. The wireline setting assembly kit also includes where said cylinder may include a cylinder wall, at least one orifice, and an internal cavity may include an upper chamber and a lower chamber; where said at least one orifice provides an opening between said lower chamber and an exterior of said cylinder; where said piston may include a piston head, a piston body, a piston bottom end, and a crosslink receptacle; where said mandrel may include a mandrel cavity, a first mandrel crosslink slot, and a second mandrel crosslink slot; where said first mandrel crosslink slot and said second mandrel crosslink slot each extend along an axial length of said mandrel; where said sleeve adapter may include a sleeve adapter cavity, a first sleeve adapter crosslink slot, and a second sleeve adapter crosslink slot; where said cylinder is configured to receive said piston head; where a bottom end of said cylinder configured to be removably fastened to a top end of said mandrel; where said sleeve adapter cavity is configured to receive said mandrel; where cylinder is configured to create an airtight seal between said piston head and an inner wall of said lower chamber; where said sleeve adapter and said piston are configured to be affixed together by said crosslink extending through said first sleeve adapter crosslink slot, said second sleeve adapter crosslink slot, and said crosslink receptacle; where said sleeve adapter, said piston, and said mandrel are configured to be slidably affixed together by said crosslink extending through said first mandrel crosslink slot and said second mandrel crosslink slot; where, when said wireline assembly kit is assembled, said crosslink, said piston, and said sleeve adapter are configured to engage in a sliding motion along said axial length; where motion of said piston along said axial length results in said piston head moving between a first location in said lower chamber and a second location in said lower chamber.

Various embodiments may include one or more of the following features. The wireline setting assembly kit where said piston and said cylinder are configured to create an annular fluid cavity between said piston body and said cylinder wall in said lower chamber, and where, when said wireline setting assembly is assembled and submerged in annular fluid, said annular fluid fills said annular fluid cavity. When said kit is assembled, a pressure in said upper chamber causes said sliding motion. When said kit is assembled and when said annular fluid is in said annular fluid cavity, flow of said annular fluid out of said annular fluid cavity through said at least one orifice causes a resistance against said sliding motion. When said kit is assembled, said pressure is released through said at least one orifice when said piston head moves to said second location. Said lower chamber has a first inner diameter at said first location and said lower chamber has a second inner diameter at said second location, where said second inner diameter is larger than said first inner diameter, and where, when said kit is assembled, said airtight seal becomes disengaged when said piston head moves to said second location. Said pressure is created by a setting charge producing charge gas that flows into said upper chamber. Each said at least one orifice is configured to receive an orifice plug and each said orifice plug further may include an orifice plug tube. Said at least one orifice is two orifices and each said orifice plug tube has a diameter of between approximately 0.010 and 0.055 inches.

One general aspect includes a method of using a wireline setting assembly to engage a downhole tool may include the steps of assembling said wireline setting assembly; attaching said downhole tool and a setting charge to said wireline setting assembly, lowering said wireline setting assembly into a casing, filling said wireline setting assembly with annular fluid in said casing, engaging said wireline setting assembly by detonating said setting charge, releasing a pressure caused by said setting charge, removing said wireline setting assembly from said casing, disassembling said wireline setting assembly. The method also includes where said wireline setting assembly may include a cylinder, a piston, a mandrel, a sleeve adapter, and a crosslink; where said cylinder may include a cylinder wall, at least one orifice, and an internal cavity may include an upper chamber and a lower chamber; where said at least one orifice provides an opening between said lower chamber and an exterior of said cylinder; where said piston may include a piston head, a piston body, a piston bottom end, and a crosslink receptacle; where said mandrel may include a mandrel cavity, a first mandrel crosslink slot, and a second mandrel crosslink slot; where said first mandrel crosslink slot and said second mandrel crosslink slot each extend along an axial length of said mandrel; where said sleeve adapter may include a sleeve adapter cavity, a first sleeve adapter crosslink slot, and a second sleeve adapter crosslink slot; where said assembling step may include the step of removably fastening a bottom end of said cylinder to a top end of said mandrel; where assembling step may include the step of inserting said crosslink through said first sleeve adapter crosslink slot, said second sleeve adapter crosslink slot, said first mandrel crosslink slot, said second mandrel crosslink slot, and said crosslink receptacle to affix said sleeve adapter to said piston and to slidably affix said piston and said sleeve adapter to said mandrel; where said assembling step may include the step of sliding said piston head into a first position of said lower chamber to create an airtight seal against an inner wall of said lower chamber; where, in said engaging step, said crosslink, said piston, and said sleeve adapter engage in a sliding motion along said axial length and motion of said piston along said axial length results in said piston head moving between said first location in said lower chamber and a second location in said lower chamber.

Various embodiments may include one or more of the following features. The method where said assembling step creates an annular fluid cavity between said piston body and said cylinder wall in said lower chamber, and where, in said filling step, annular fluid flows from said casing into said annular fluid cavity. In said engaging step, detonating said setting charge creates said pressure in said upper chamber and said pressure causes said sliding motion. In said engaging step, flow of said annular fluid out of said annular fluid cavity through said at least one orifice causes a resistance against said sliding motion. In said releasing step, said pressure is released through said at least one orifice when said piston head moves to said second location. Said lower chamber has a first inner diameter at said first location and said lower chamber has a second inner diameter at said second location, where said second inner diameter is larger than said first inner diameter, and where, in said releasing step, said airtight seal becomes disengaged when said piston head moves to said second location. Each said at least one orifice is configured to receive an orifice plug and each said orifice plug further may include an orifice plug tube. Said assembling step may include the steps of identifying a desired level of said resistance, installing each said orifice plug in each said at least one orifice, where each said orifice plug has an orifice plug tube size selected to achieve said desired level of said resistance. Said at least one orifice is two orifices and each said orifice plug tube has a diameter of between approximately 0.010 and 0.055 inches.

DETAILED DESCRIPTION OF THE INVENTION

Figure 1A:
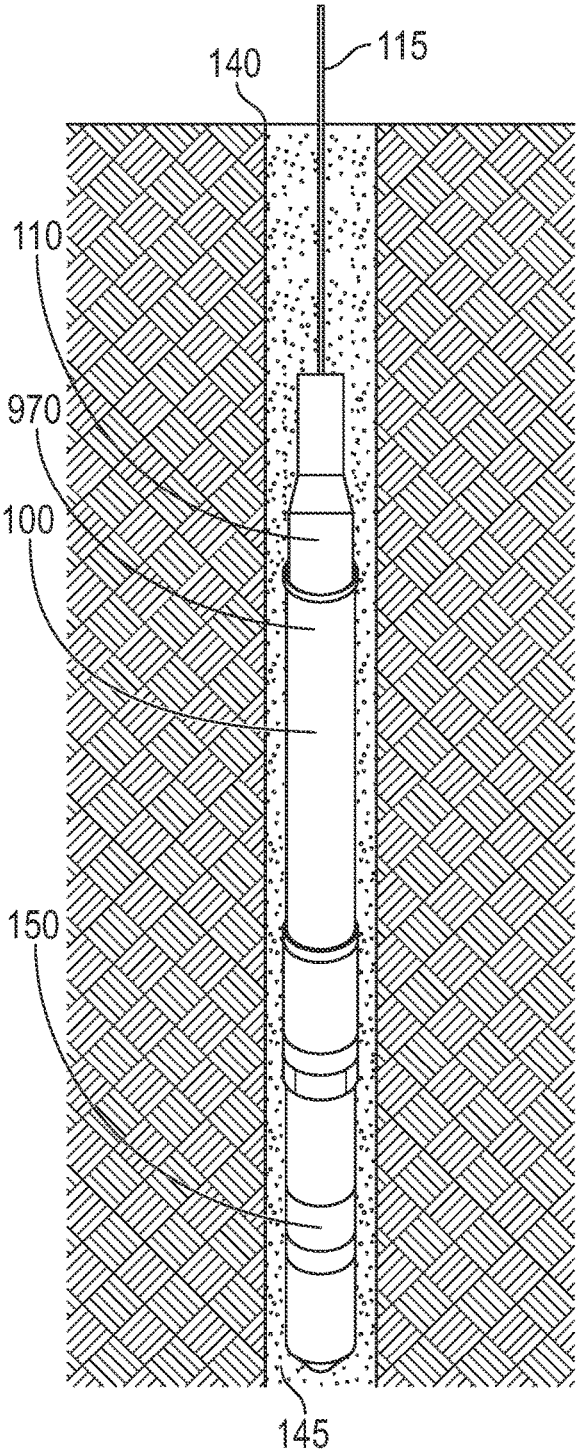
FIG. 1A is a side view of a wireline setting assembly in a borehole before being engaged.

Example embodiments of the inventive concepts will now be described more fully with reference to the accompanying drawings, in which example embodiments are shown. Example embodiments of the inventive concepts may, however, be embodied in many different forms and should not be construed as being limited to the embodiments set forth herein; rather, these embodiments are provided so that this disclosure will be thorough and complete, and will fully convey the concept of example embodiments to those of ordinary skill in the art. In the drawings, the thicknesses of layers and regions may be exaggerated for clarity. Like reference numerals in the drawings denote like elements, and thus their description will be omitted.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. As used herein the term "and/or" includes any and all combinations of one or more of the associated listed items. Other words used to describe the relationship between elements or layers should be interpreted in a like fashion (e.g., "between" versus "directly between," "adjacent" versus "directly adjacent," "on" versus "directly on").

It will be understood that, although the terms "first", "second", etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of example embodiments.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

As used herein, the singular forms "a," "an" and "the" are intended to include the plural forms as well, unless the context clearly indicates otherwise. It will be further understood that the terms "comprises", "comprising", "includes" and/or "including," if used herein, specify the presence of stated features, integers, steps, operations, elements and/or components, but do not preclude the presence or addition of one or more other features, integers, steps, operations, elements, components and/or groups thereof.

The terminology used herein is for the purpose of describing particular embodiments only and is not intended to be limiting of example embodiments. Example embodiments of the inventive concepts are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments of the inventive concepts should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which example embodiments of the inventive concepts belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

Figure 1B:
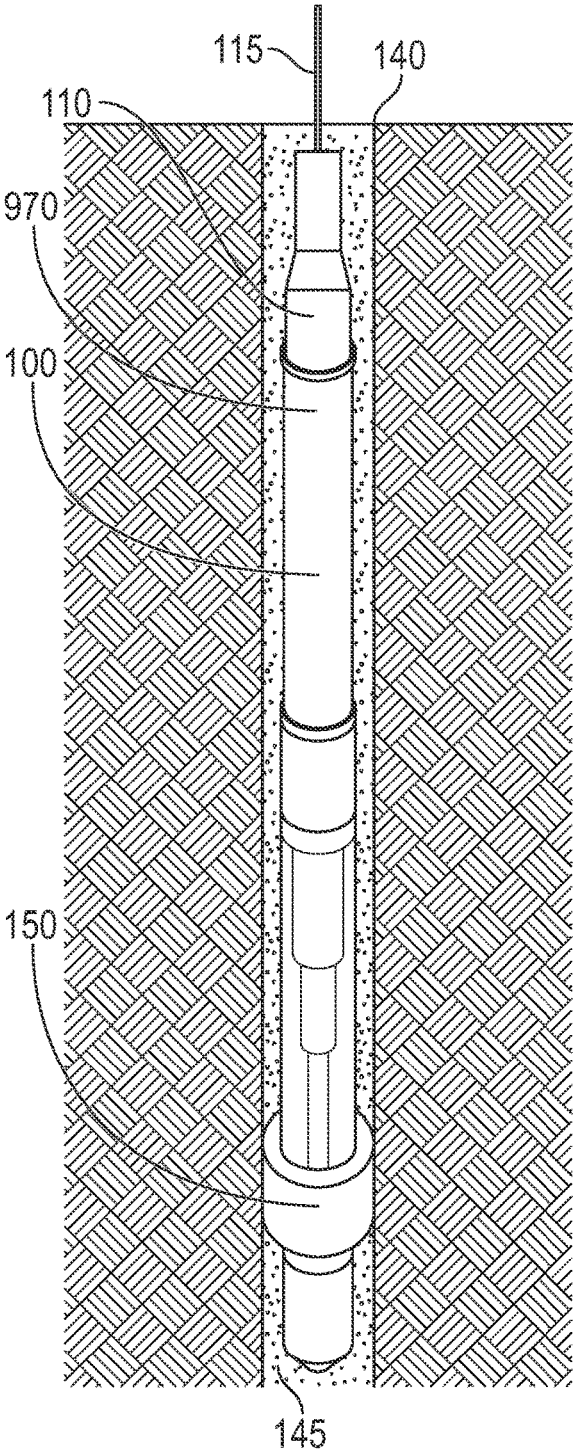
FIG. 1B is a side view of a wireline setting assembly in a borehole after being engaged to set a plug.

Turning now to the figures, FIGS. 1A and 1B show an embodiment of wireline setting assembly 100, wireline detonator 110, wire 115, casing 140, annular fluid 145, and tool 150. As shown, tool 150 is operatively connected to a bottom end of wireline setting assembly 100, wireline detonator 110 is operatively connected to a top end of wireline setting assembly 100, wire 115 is electrically connected to wireline detonator 110, and all of same are located in casing 140, which casing 140 is filled with annular fluid 145. This type of wire 115, wireline detonator 110 and associated setting charge 970 (see, e.g., FIGS. 9A-9B), and tool 150 are known in the field and have been used in downhole operations for many years.

Casing 140 is a casing commonly used in the oil and gas industry to protect oil and gas boreholes used to extract hydrocarbons from the Earth's crust. To the extent that this application or the claims discuss an object being inside or within the casing 140, such usage means that an object is inside or within the cavity formed by casing (e.g., in the borehole with the casing being located on the walls of the borehole). Annular fluid 145 is a liquid circulating within casing 140. A person of ordinary skill in the art understands that a borehole may be of varying sizes as determined by drilling needs, that an appropriate casing 140 may be chosen for the particular size of the borehole, and that annular fluid 145 is generally comprised primarily of water but may have other components such as sodium chloride or zinc added thereto, to change the properties of annular fluid 145.

As shown in FIGS. 1A and 1B, wireline detonator 110 is a wireline detonator capable of detonating a setting charge 970 based on receipt of an electrical current via wire 115. When a setting charge 970 detonates and creates pressure inside wireline setting assembly 100, wireline setting assembly 100 engages as discussed in more detail below.

FIG. 1A shows wireline setting assembly 100 before it engages and FIG. 1B shows wireline setting assembly 100 after it engages. As depicted in these two figures, wireline setting assembly 100 expands along the length of the casing 140 such that wireline setting assembly bottom end 102 (see FIGS. 9A/9B) stays in a fixed position and wireline setting assembly top end 101 moves relative to wireline setting assembly bottom end 102, in the embodiment depicted in FIGS. 1A and 1B, upwards. This motion is desired because wireline setting assembly 100 is configured to removably connect to a tool 150 on wireline setting assembly bottom end 102; and it is desirable that tool 150 remain in a fixed position when tool 150 is engaged.

FIG. 1B shows internal components of wireline setting assembly 100 which are not typically visible from the outside of wireline setting assembly 100 to demonstrate that motion of internal components causes the motion of wireline setting assembly 100 between FIGS. 1A and 1B.

As shown in FIG. 1B, engagement of wireline setting assembly 100 causes activity in tool 150. In the depicted embodiments, tool 150 is a packing tool compliant with API Standard 11D1, and engagement of wireline setting assembly 100 causes certain activity, namely, expansion of tool 150 towards the casing 140 to secure casing 140 in a borehole.

As shown in more detail below, exemplary embodiments of wireline setting assembly 100 comprise, at least, cylinder 200, piston 300 with a plurality of o rings 350, mandrels such as mandrel 400 or alternative mandrel 500, crosslink 600, crosslink fastener 650, sleeve adapter 700, one or more orifice plugs 800, tool adapter 980 or optionally alternative tool adapter 1000, second alternative tool adapter 1100 or other adapters.

Figure 1C:
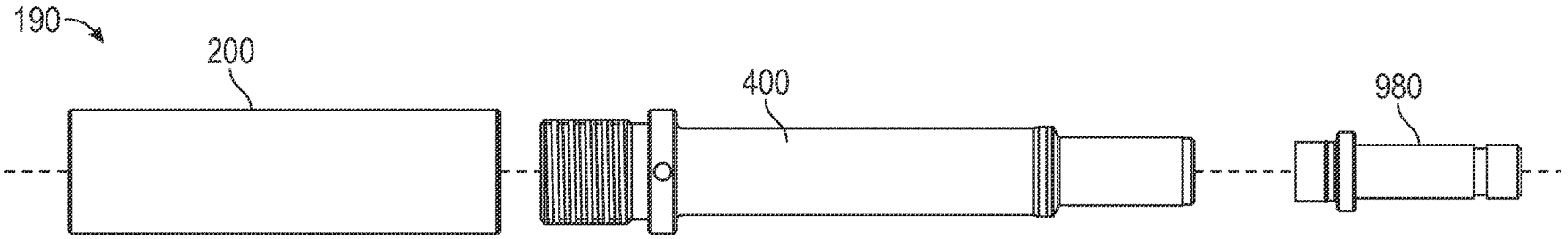
FIG. 1C is an exploded view of a cylinder, a mandrel, and a tool adapter of a wireline setting assembly.
Figure 1D:
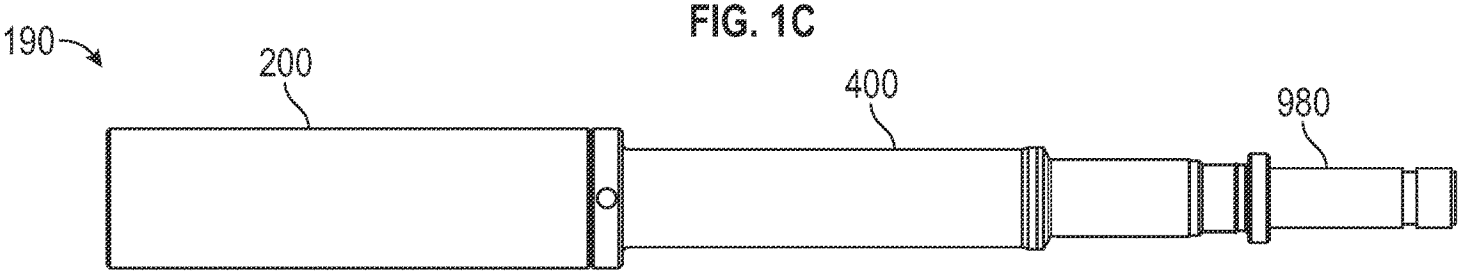
FIG. 1D is a side view of a cylinder, a mandrel, and a tool adapter of a wireline setting assembly.

FIGS. 1C and 1D show a first group of components 190 of wireline setting assembly 100 comprising a cylinder 200, a mandrel 400, and a tool adapter 980. FIG. 1C shows an exploded view, and FIG. 1D shows a connected view, of the configuration of a cylinder 200 connecting to a mandrel 400 and a mandrel 400 connecting to a tool adapter 980.

Figure 1E:
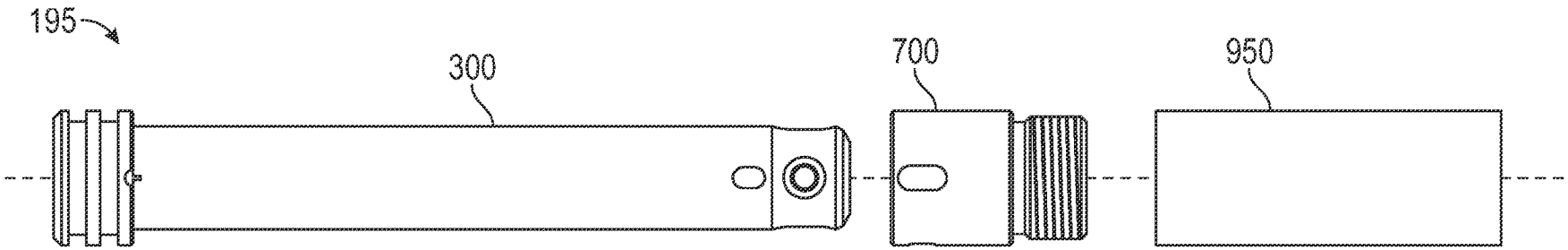
FIG. 1E is an exploded view of a piston, a sleeve adapter, and a setting sleeve.
Figure 1F:
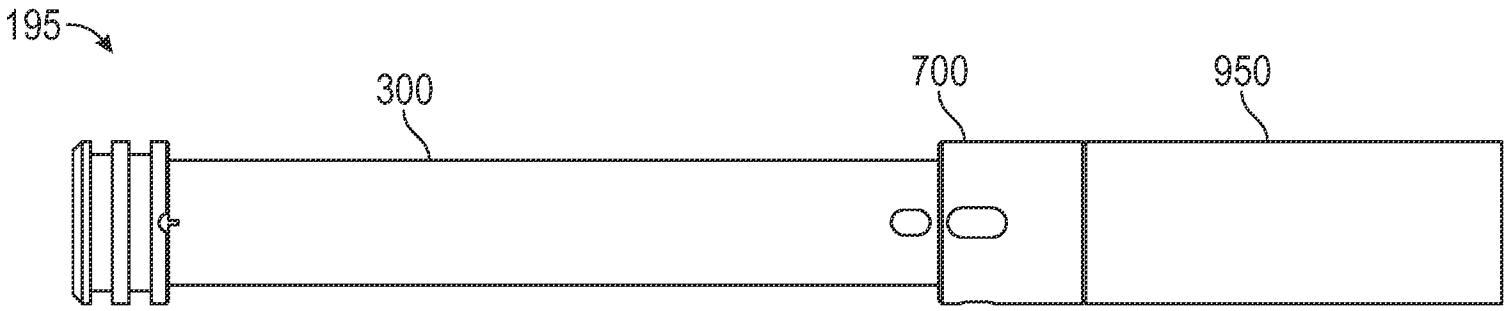
FIG. 1F is a side view of a piston, a sleeve adapter, and a setting sleeve.

FIGS. 1E and 1F show a second group of components 195 of wireline setting assembly 100 comprising piston 300, sleeve adapter 700, and setting sleeve 950. FIG. 1E shows an exploded view, and FIG. 1F shows a connected view, of the configuration of a piston 300 connecting to a sleeve adapter 700, and a sleeve adapter 700 connecting to a setting sleeve 950.

The parts shown in FIGS. 1C, 1D, 1E, and 1F are assembled in the following order. First, all parts should be inspected for damage or deformation. Second, install an o ring 350 into first o ring groove 306 and another o ring 350 into second o ring groove 307. Each o ring 350 should then be greased. Third, piston bottom end 302 of piston 300 is inserted into mandrel 400, with mandrel access port 422 aligned with crosslink fastener receptacle 320. Fourth, slide sleeve adapter 700 onto mandrel with sleeve adapter bottom end 702 facing the same direction as mandrel bottom end 402 and sleeve adapter crosslink fastener holes 715 aligned with mandrel access port 422 and crosslink fastener receptacle 320. This alignment also aligns sleeve adapter crosslink adapter slots. 710, mandrel crosslink slot 425, and crosslink receptacle 330. Fifth, crosslink 600 is inserted through sleeve adapter crosslink slots 710, mandrel crosslink slot 425, and crosslink receptacle 330. Crosslink fastener 650 is then inserted into sleeve adapter crosslink fastener holes 715, mandrel access port 422, and crosslink fastener receptacle 320 (screwing into crosslink fastener receptacle 320). This step accomplishes the goal of affixing piston 300 to sleeve adapter 700 such that both piston 300 and sleeve adapter 700 slide within mandrel 400 along mandrel crosslink slot 425. Sixth, mandrel top threads 405 are greased and mandrel top threads 405 are threaded into cylinder bottom threads 210. Seventh, set screws are inserted into mandrel setting threads 227, thereby further securing mandrel 400 to cylinder 200. Eighth, sleeve adapter 700 is moved so that sleeve adapter 700 is directly adjacent to mandrel ring 410, and anti-preset shear pins 470 are inserted into anti-preset shear pin threaded receivers 415*a*-415*b*. Ninth, orifice plugs 800 are threaded into orifices 225*a*-225*b*.

When assembled into wireline setting assembly 100, the first group of components 190 shown in FIGS. 1C and 1D move in unison and the second group of components 195 shown in FIGS. 1E and 1F move in unison. In other words, cylinder 200, mandrel 400, and tool adapter 980 move in unison; and piston 300, sleeve adapter 700, and setting sleeve 950 move in unison.

Figure 1G:
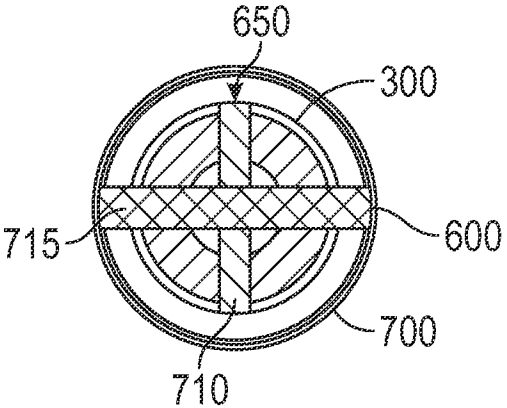
FIG. 1G is a top cross-section view of a piston, a sleeve adapter, a crosslink, and a crosslink fastener.

FIG. 1G shows a top cross section view of second group of components 195 (see FIG. 1F) showing how crosslink 600 affixes piston 300 to sleeve adapter 700 and how crosslink fastener 650 affixes crosslink 600 to piston 300.

This view does not show mandrel 400. However, when a first group of components 190 are assembled with a second group of components 195 to form a wireline setting assembly 100, piston 300 is slidably engaged with mandrel 400 and crosslink 600 slides in mandrel crosslink slot 425 limiting the sliding engagement of piston 300 in mandrel 400 and thereby also restricting the range of motion of first group of components 190 in relation to second group of components 195.

FIGS. 2A, 2B, 2C, and 2D depict one embodiment of a cylinder 200, showing cylinder top end 201, cylinder bottom end 202, cylinder wall 204, cylinder top threads 205, cylinder bottom threads 210, upper chamber 215, lower chamber 220, orifices 225*a* and 225*b*, charge setting threads 226*a*-226*b*, and mandrel setting threads 227. Setting screws are inserted into charge setting threads 226*a*-226*b* to further secure setting charge 970 to cylinder 200. Setting screws are inserted into mandrel setting threads 227 to further secure mandrel 400 to cylinder 200. Although FIGS. 2A-2D only depict one mandrel setting threads 227, a plurality of mandrel setting threads 227 may be used.

The dimensions shown in the all of figures are for exemplary embodiments of wireline setting assembly 100, which may be scaled up or down as needed for use in casing 140 of varying sizes.

In the depicted exemplary embodiment, upper chamber 215 is fluidly connected to lower chamber 220. In preferred embodiments, upper chamber 215 is cylindrical and has a diameter suitable for receiving a portion of a setting charge 970 and lower chamber 220 has a diameter suitable for receiving piston 300 such that when piston 300 is configured with o rings 350 and a piston top end 301 is inserted into lower chamber 220, the o rings 350 form an airtight barrier that varies in position as piston 300 moves, with the airtight seal separating (depending on specific location) areas within lower chamber 220 on either side of the airtight seal.

In the depicted exemplary embodiment, lower chamber 220 also comprises lower chamber expansion 221. Lower chamber expansion 221 is a portion of lower chamber 220 that has larger inner diameter than other portions of lower chamber 220.

In one preferred embodiment, cylinder top threads 205 are 2 ⅜-6 Acme threads, orifices 225*a*-225*b* are ¼" NPT, charge setting threads 226*a*-226*b* are 5-40 UNC-2B tapped holes, mandrel setting threads 227 are ¼-20 UNC, and cylinder bottom threads 210 are 2.30-8 Acme threads.

Figure 3A:
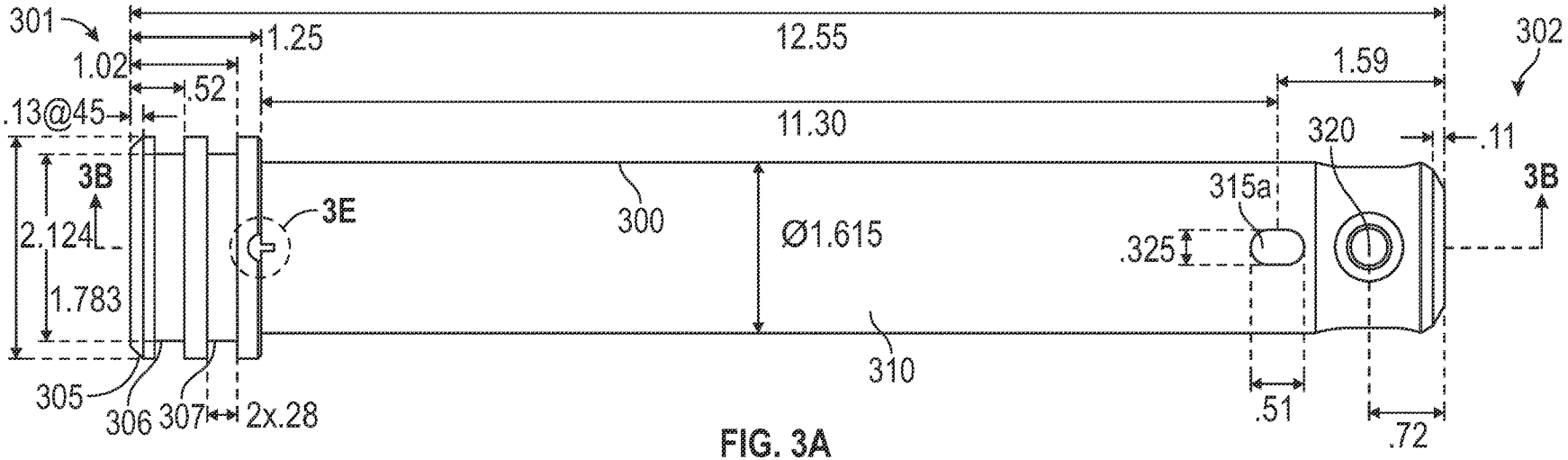
FIG. 3A is a side view of a piston of a wireline setting assembly.
Figure 3B:
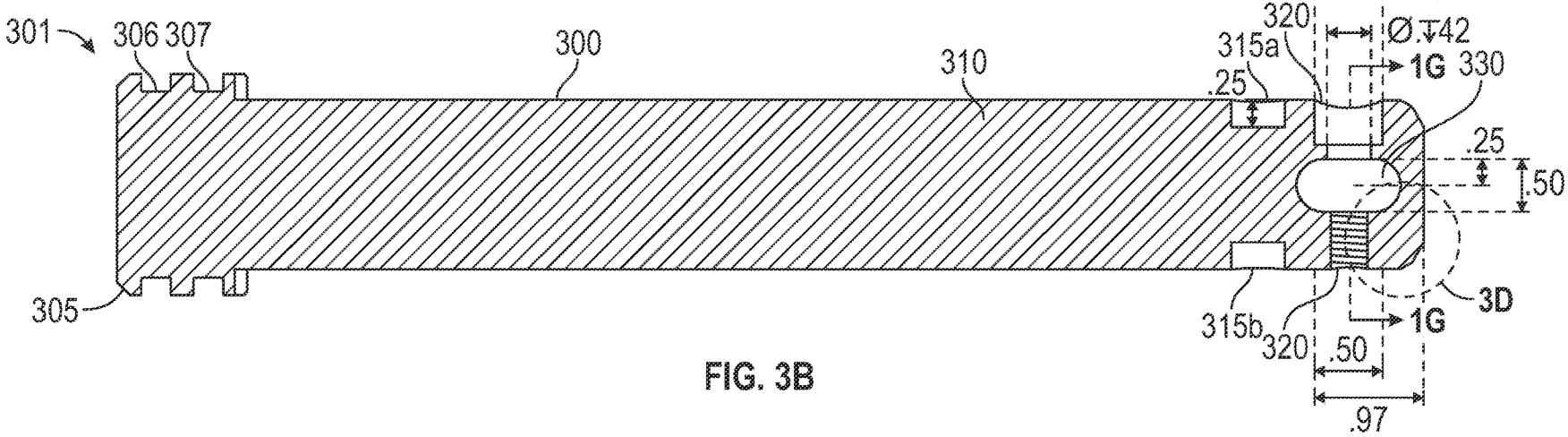
FIG. 3B is a side cross-section view of a piston of a wireline setting assembly.
Figure 3C:
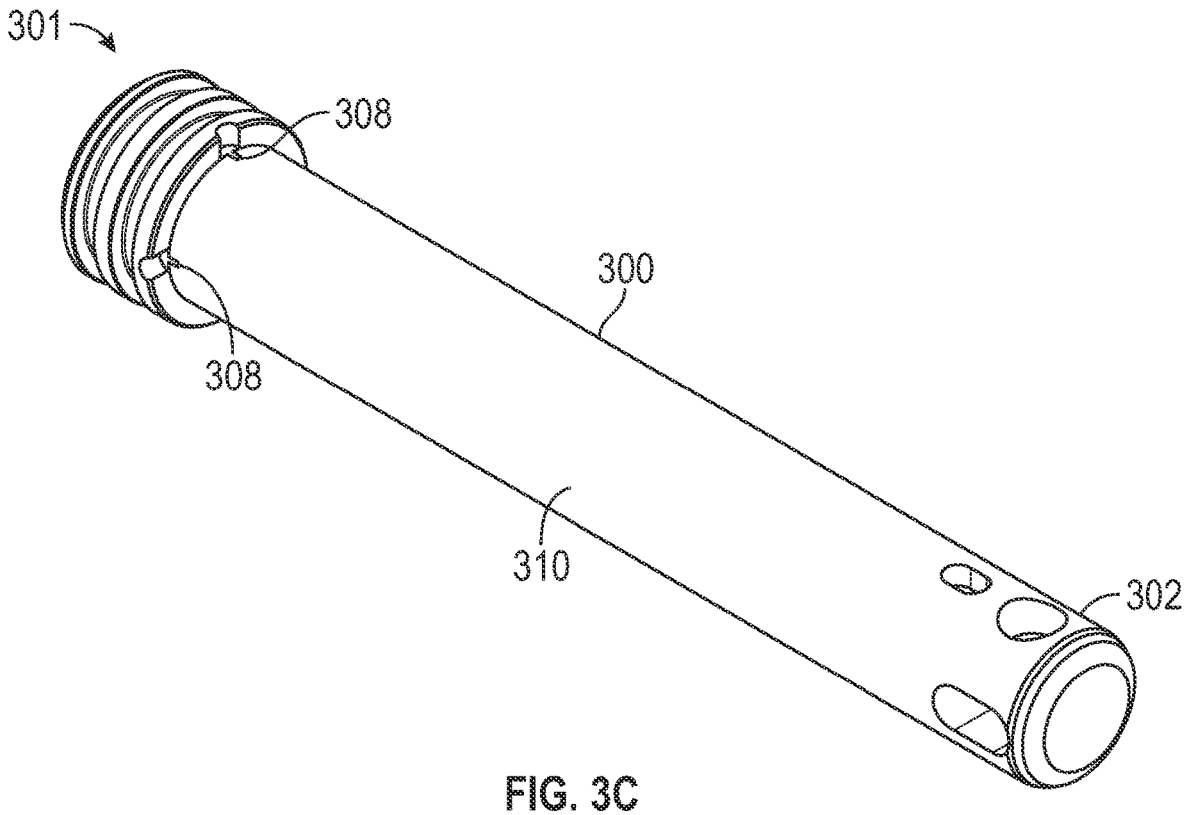
FIG. 3C is a perspective view of a piston of a wireline setting assembly.
Figure 3D:
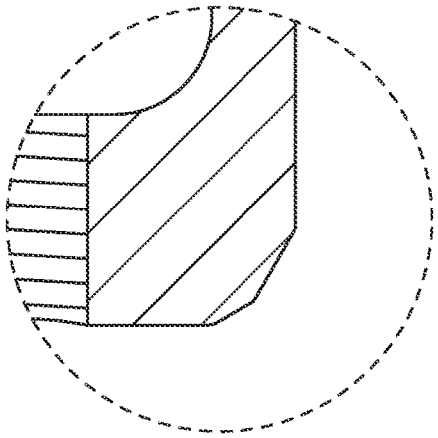
FIG. 3D is a side cross-section view of a bottom end of a piston of a wireline setting assembly.
Figure 3F:
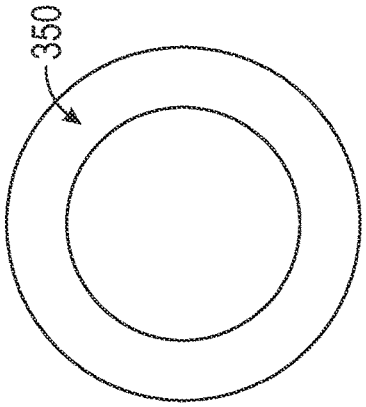
FIG. 3F is a side view of an o ring.
Figure 3E:
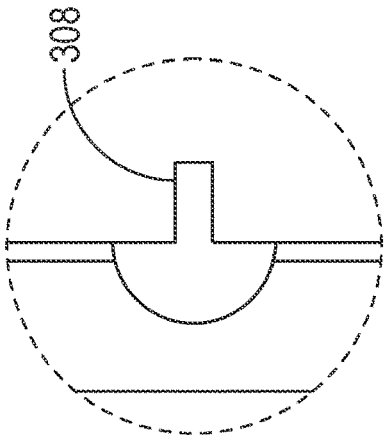
FIG. 3E is a side detail view of a top end of a piston of a wireline setting assembly.

FIGS. 3A, 3B, 3C, 3D, and 3E depict one embodiment of a piston 300, showing piston top end 301, piston bottom end 302, piston head 305, first o ring groove 306, second o ring groove 307, piston body 310, anti-preset shear pin receptacles 315*a*-315*b*, crosslink fastener receptacle 320, and crosslink receptacle 330. FIG. 3F depicts an o ring 350. In a preferred embodiment, o ring 350 is a gasket in the form of a ring shape with a circular cross section made of a pliable material and is used to create a seal. In such preferred embodiments, o ring 350 is made of buna, nitrile, viton, or aflas.

In preferred embodiments, piston 300 is configured with one o ring 350 in first o ring groove 306 and one o ring 350 in second o ring groove 307.

Some embodiments of piston 300 include one or more head cutouts 308. Head cutouts 308 prevent charge gas 975 or annular fluid 145 from being trapped between piston head 305 and mandrel 400 by preventing a complete metal-to-metal seal when piston is fully extended to be flush with mandrel 400.

Figure 4A:
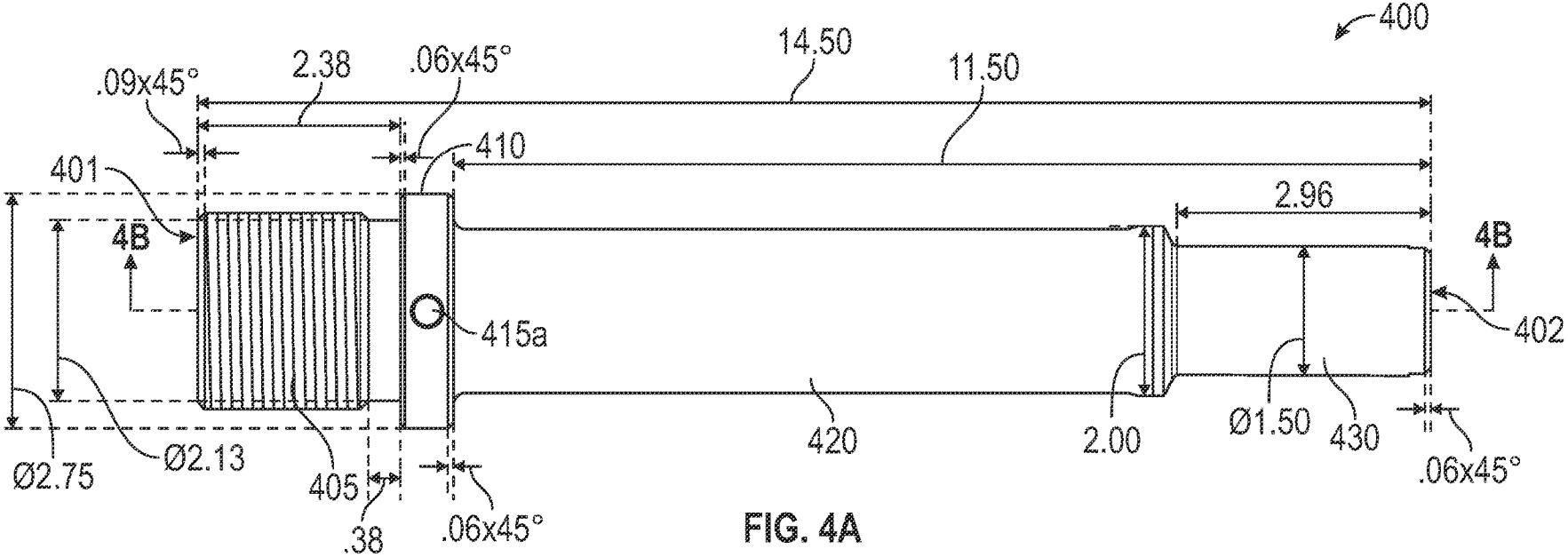
FIG. 4A is a side view of a mandrel of a wireline setting assembly.
Figure 4B:
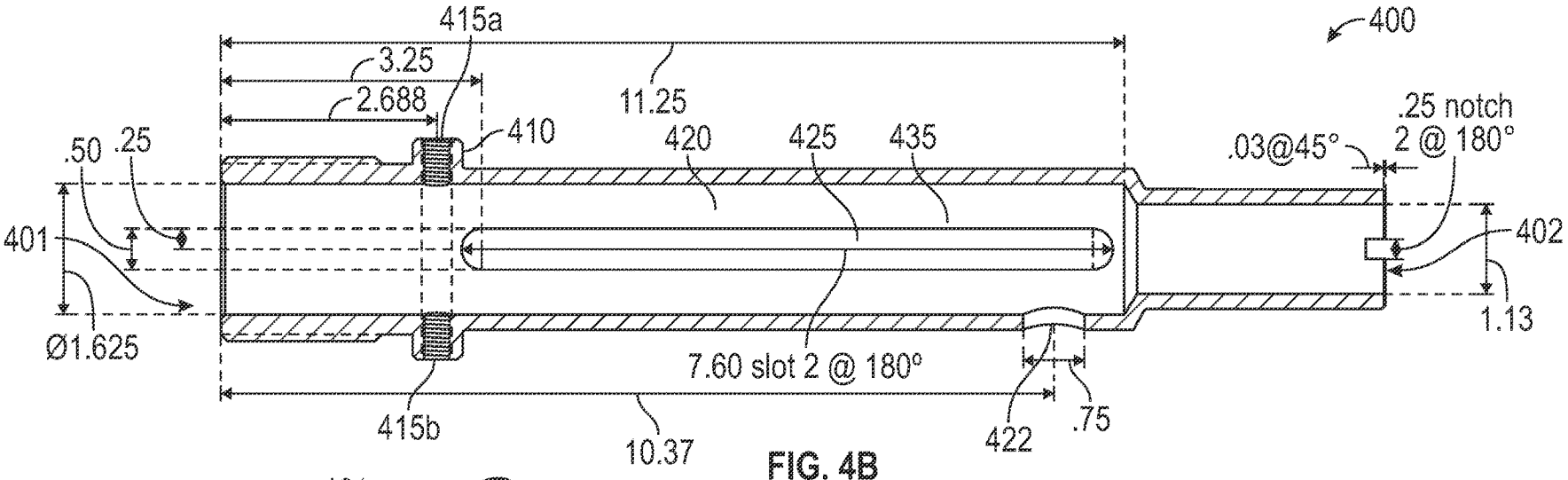
FIG. 4B is a side cross-section view of a mandrel of a wireline setting assembly.
Figure 4C:
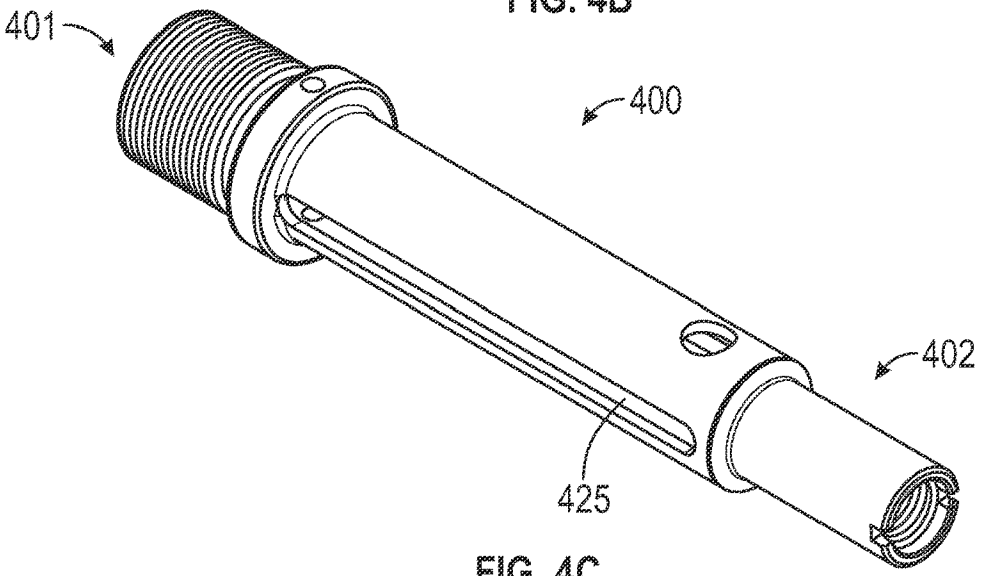
FIG. 4C is a perspective view of a mandrel of a wireline setting assembly.
Figure 4D:
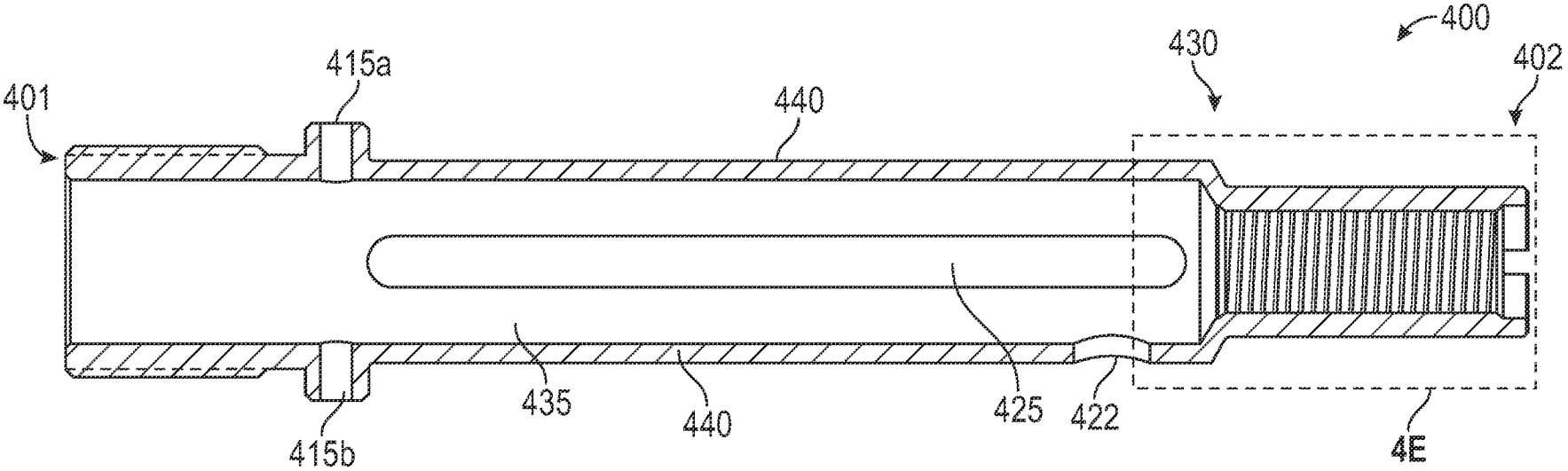
FIG. 4D is a side cross-section view of a mandrel of a wireline setting assembly.
Figure 4F:
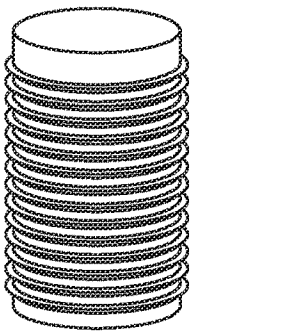
FIG. 4F is a perspective view of an anti-preset shear pin.
Figure 4E:
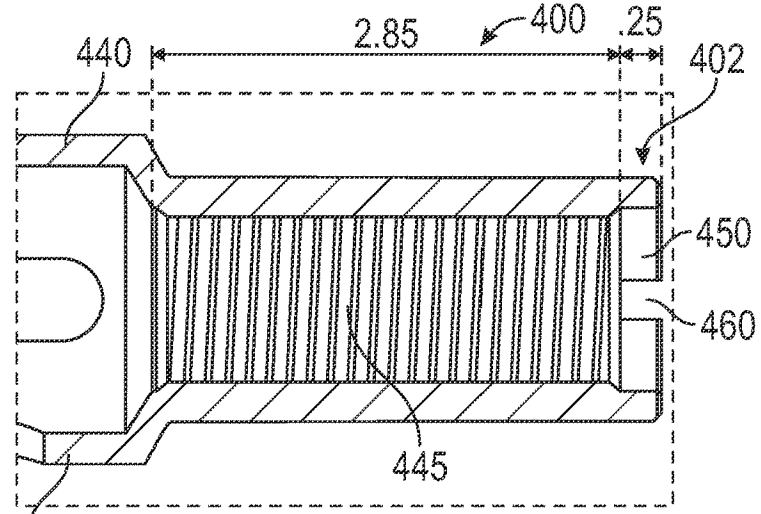
FIG. 4E is a detail view of a bottom end of a mandrel of a wireline setting assembly.

FIGS. 4A, 4B, 4C, 4D, and 4E depict one embodiment of mandrel 400, showing mandrel top end 401, mandrel bottom end 402, mandrel top threads 405, mandrel ring 410, anti-preset shear pin threaded receivers 415*a*-415*b*, mandrel body 420, mandrel access port 422, mandrel crosslink slots 425, mandrel tip 430, mandrel cavity 435, mandrel wall 440, mandrel bottom threads 445, mandrel bottom barrier 450 (shown in FIG. 4E), and mandrel bottom slot 460 (shown in FIG. 4E). FIG. 4F depicts anti-preset shear pin 470.

A mandrel 400 is a generally cylindrically-shaped length of material that, in this exemplary embodiment, attaches to cylinder 200 and which piston 300 slides within as restricted by motion of crosslink 600 in mandrel crosslink slots 425.

Mandrel body 420 includes mandrel wall 440, which surrounds mandrel cavity 435. Mandrel top threads 405 are configured to thread into cylinder bottom threads 210, and mandrel cavity is configured to slidably receive piston body 310. Mandrel crosslink slots 425 are openings in mandrel 400 configured to receive crosslink 600, and crosslink fastener receptacle 320 is an opening in piston 300 configured to receive crosslink fastener 650.

Anti-preset shear pins 470 are threaded pins configured to be threaded through anti-preset shear pin threaded receivers 415*a*-415*b* and into anti-preset shear pin receptacles 315*a*-315*b* of piston 300, thereby securing piston 300 in place relative to cylinder 200 and mandrel 400. Some preferred embodiments are configured for two anti-preset shear pins 470, but a different number may be used. Collectively, the anti-preset shear pins 470 are designed to secure piston 300 in place prior to wireline setting assembly 100 being engaged (i.e., the weight of piston 300 and other devices fixed thereto is not sufficient to shear all anti-preset shear pins 470); and, the anti-preset shear pins 470 are designed to shear when wireline setting assembly 100 is engaged (i.e., force is applied to piston 300 and anti-preset shear pin receptacles 315*a*-315*b* push against anti-preset shear pins 470 and thereby cause shearing of anti-preset shear pins 470. In this embodiment, mandrel bottom threads 445 are 1-8 UNC—2B threads.

Figure 5A:
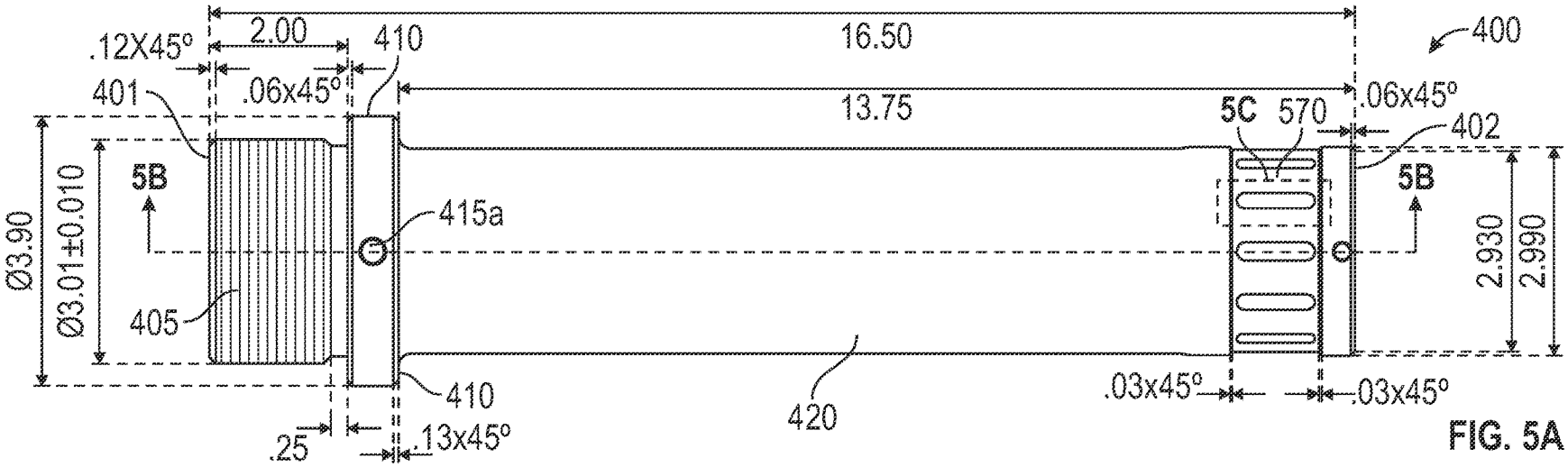
FIG. 5A is a side view of a mandrel of a wireline setting assembly.
Figure 5B:
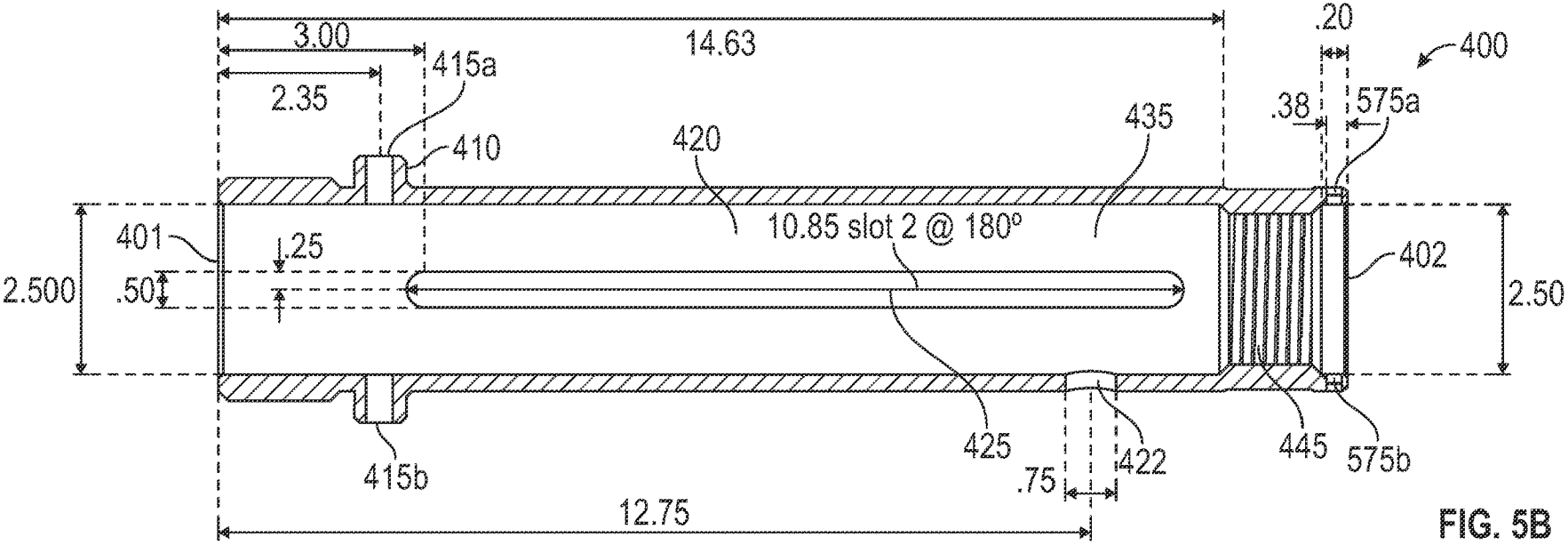
FIG. 5B is a side cross-section view of a mandrel of a wireline setting assembly.
Figure 5C:
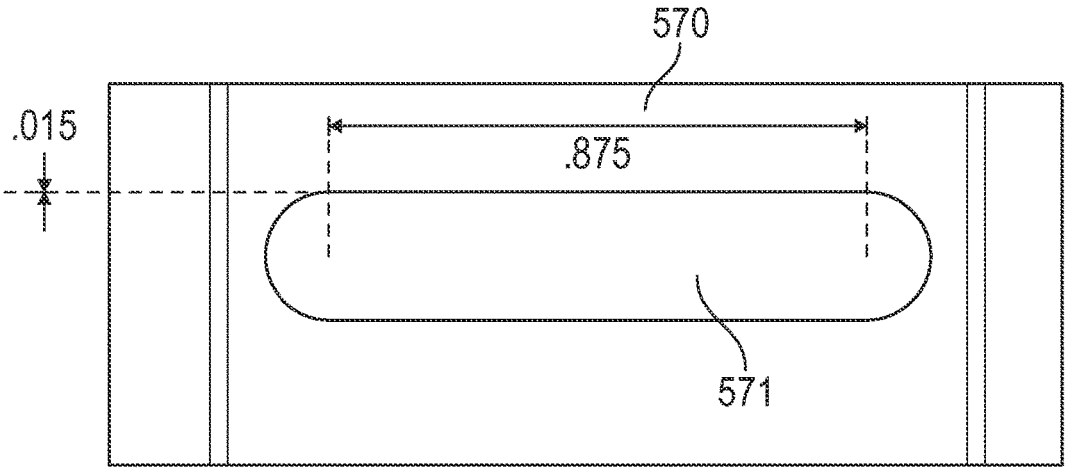
FIG. 5C is a detail view of flats around a mandrel of a wireline setting assembly.
Figure 5D:
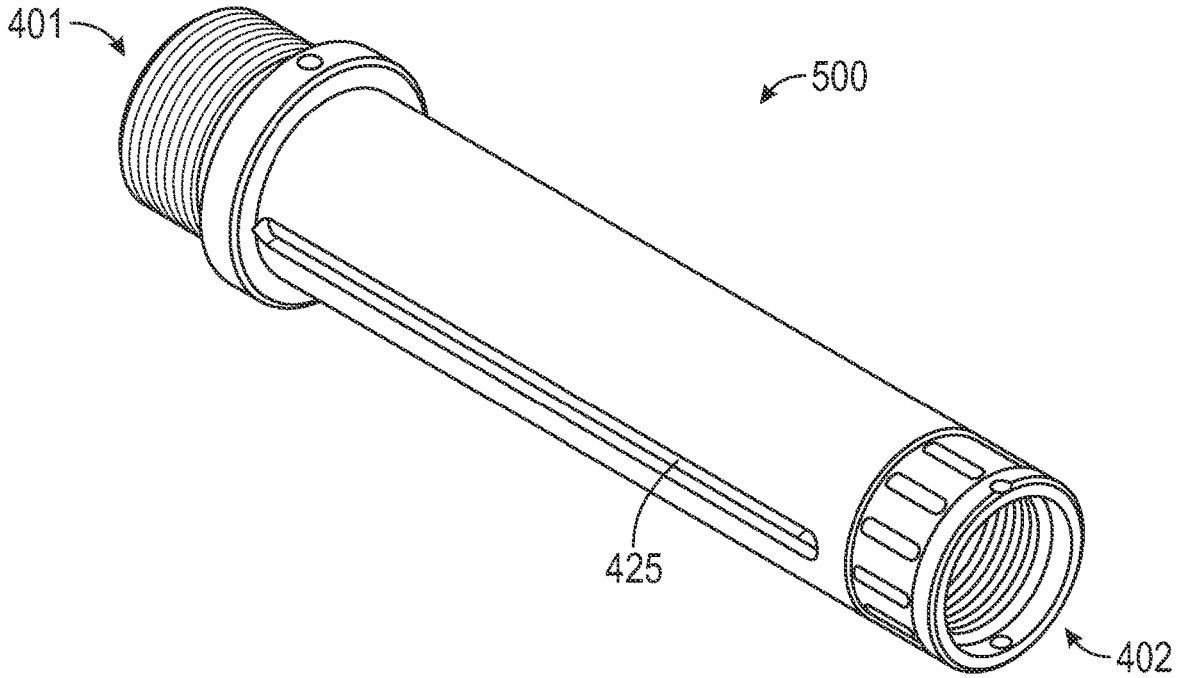
FIG. 5D is a perspective view of a mandrel of a wireline setting assembly.

FIGS. 5B-5D show an alternative embodiment of mandrel 400, which is also configured with adapter setting threads 575*a*-575*b* and grip 570. Grip 570 is a surface near mandrel bottom end 402 and further comprises a plurality of flat edges 571. Grip 570 and flat edges 571 are provided in some embodiments of mandrel 400 so that a wrench can grip mandrel 400 to facilitate rotation of mandrel 400 during assembly or disassembly. Adapter setting threads 575*a*-575*b* are threads for receiving a setting pin that further secures mandrel 400 to tool adapter 980. In this embodiment, mandrel bottom threads 445 are 2.375"-6 ACME threads.

Figure 6A:
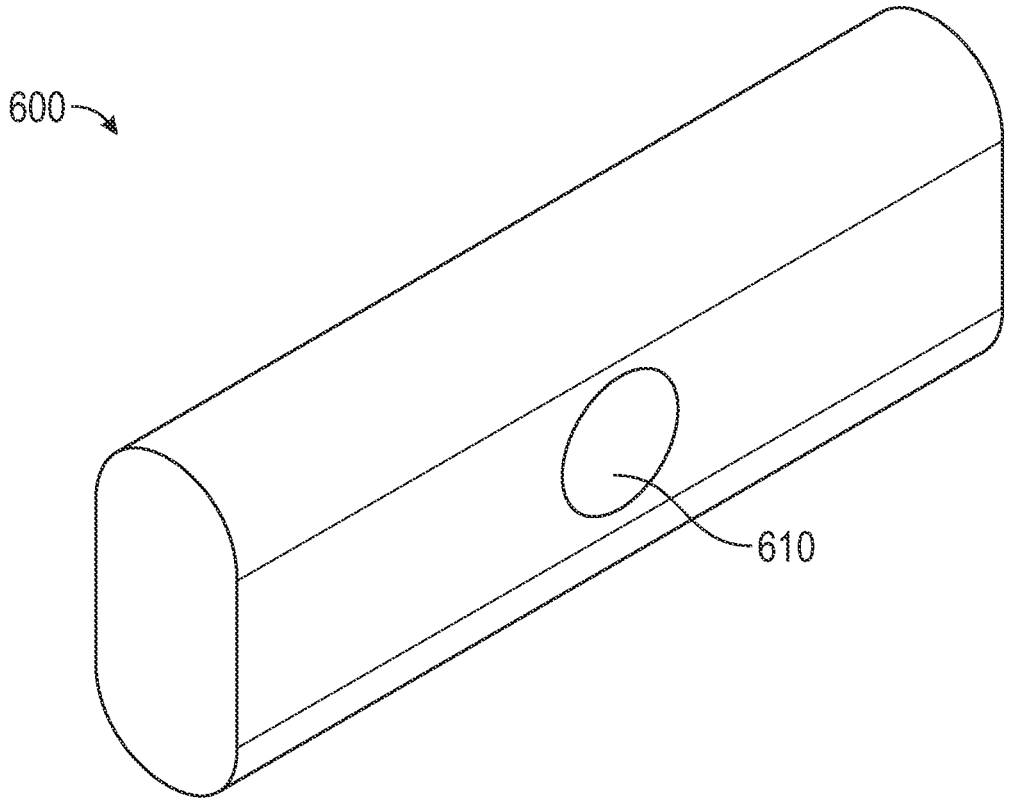
FIG. 6A is a perspective view of a crosslink of a wireline setting assembly.
Figure 6B:
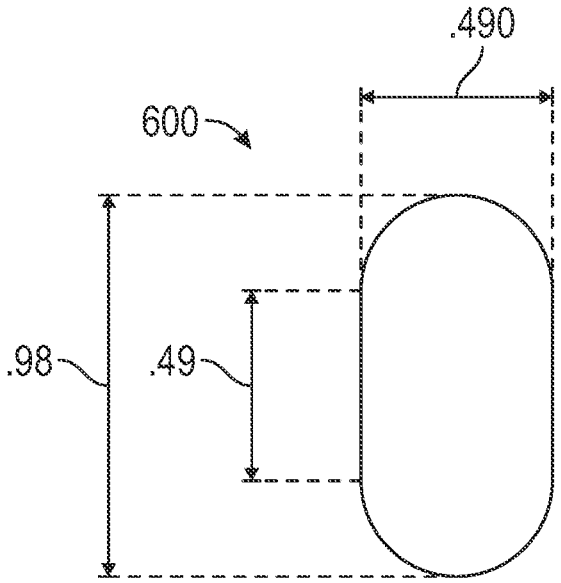
FIG. 6B is a side view of a crosslink of a wireline setting assembly.
Figure 6C:
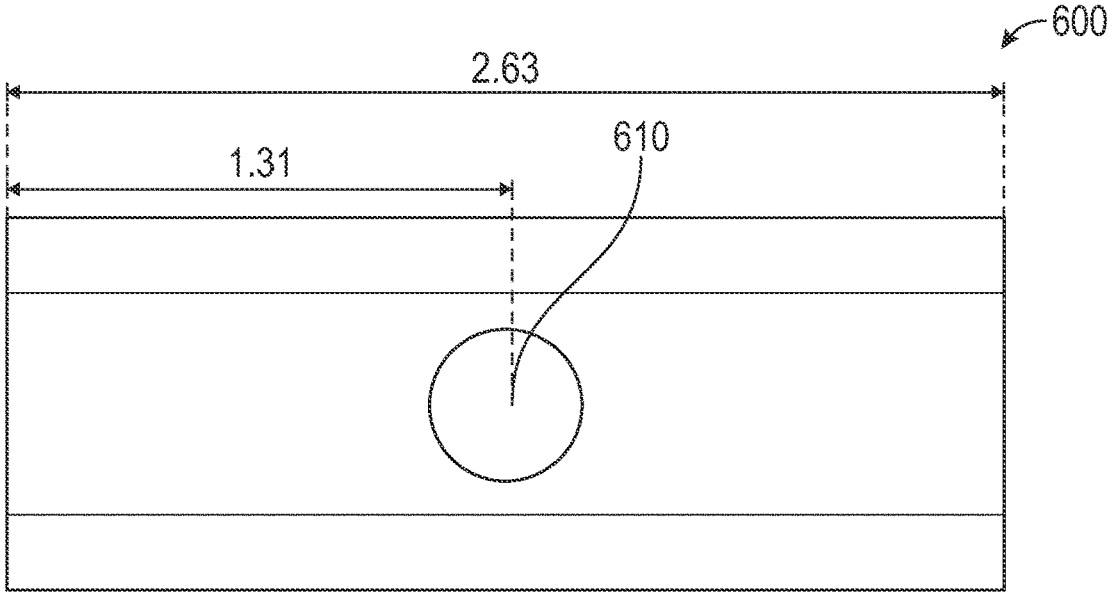
FIG. 6C is a different side view of a crosslink of a wireline setting assembly.

FIGS. 6A, 6B, and 6C depict an embodiment of a crosslink 600. A crosslink 600 is a member that serves to secure sleeve adapter 700 to piston 300 such that motion of piston 300 causes motion of sleeve adapter 700 as restricted by crosslink 600 in mandrel crosslink slots 425. Crosslink 600 comprises crosslink hole 610.

Figure 6D:
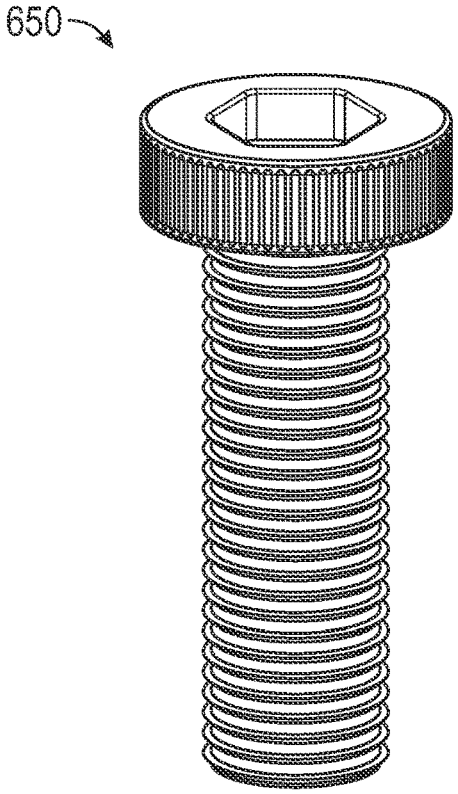
FIG. 6D is a side view of a crosslink fastener of a wireline setting assembly.

FIG. 6D depicts crosslink fastener 650. Crosslink hole 610 is configured to receive crosslink fastener 650. Embodiments of wireline setting assembly 100 are configured so that crosslink fastener 650 secures crosslink 600 to piston 300 via crosslink fastener receptacle 320. In the depicted embodiment, crosslink fastener receptacle 320 includes threads configured to receive crosslink fastener 650, and crosslink fastener 650 is a threaded screw with an end cap for rotating crosslink fastener 650 into crosslink fastener receptacle 320.

Figure 7A:
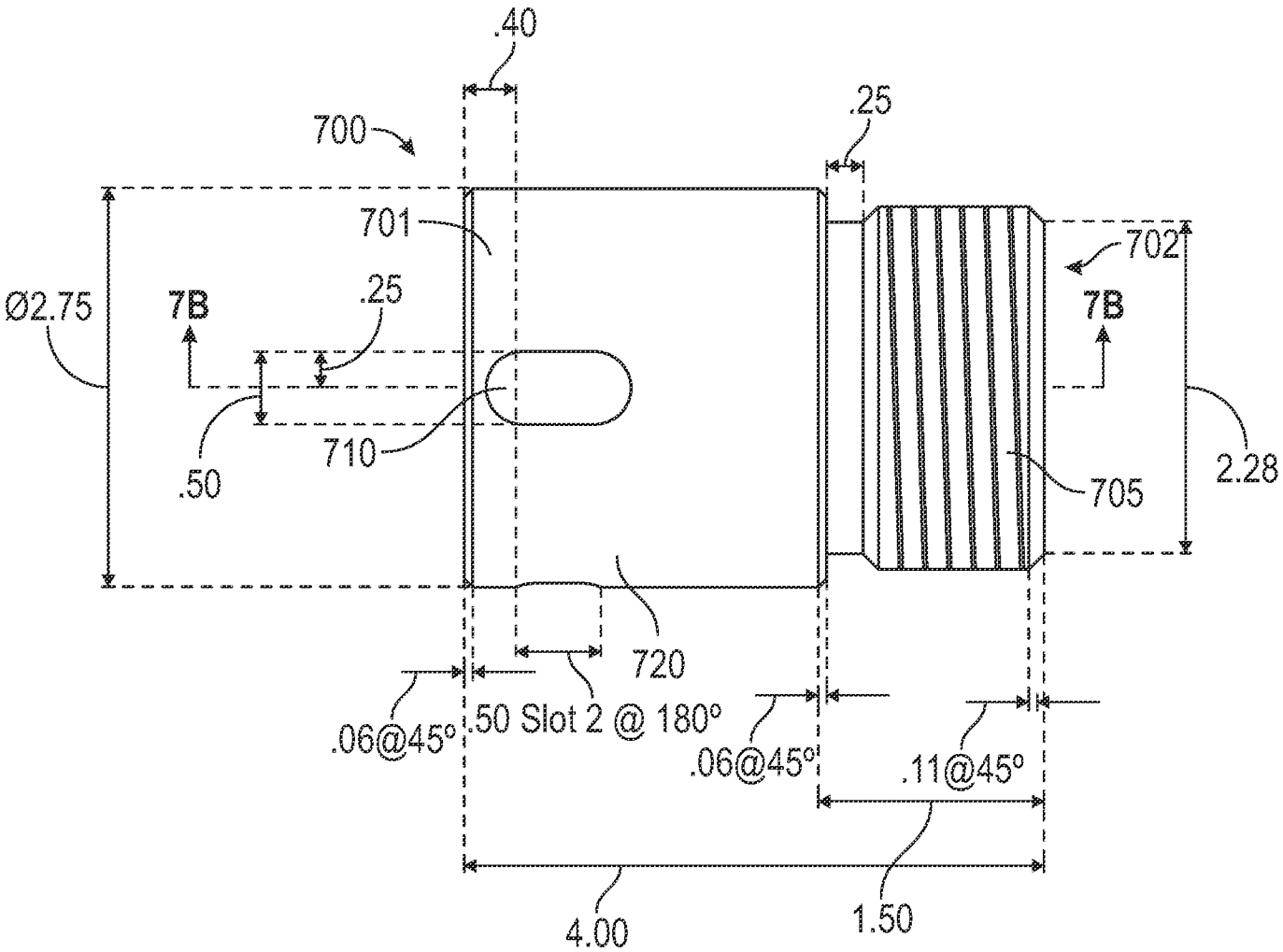
FIG. 7A is a side view of a sleeve adapter of a wireline setting assembly.
Figure 7B:
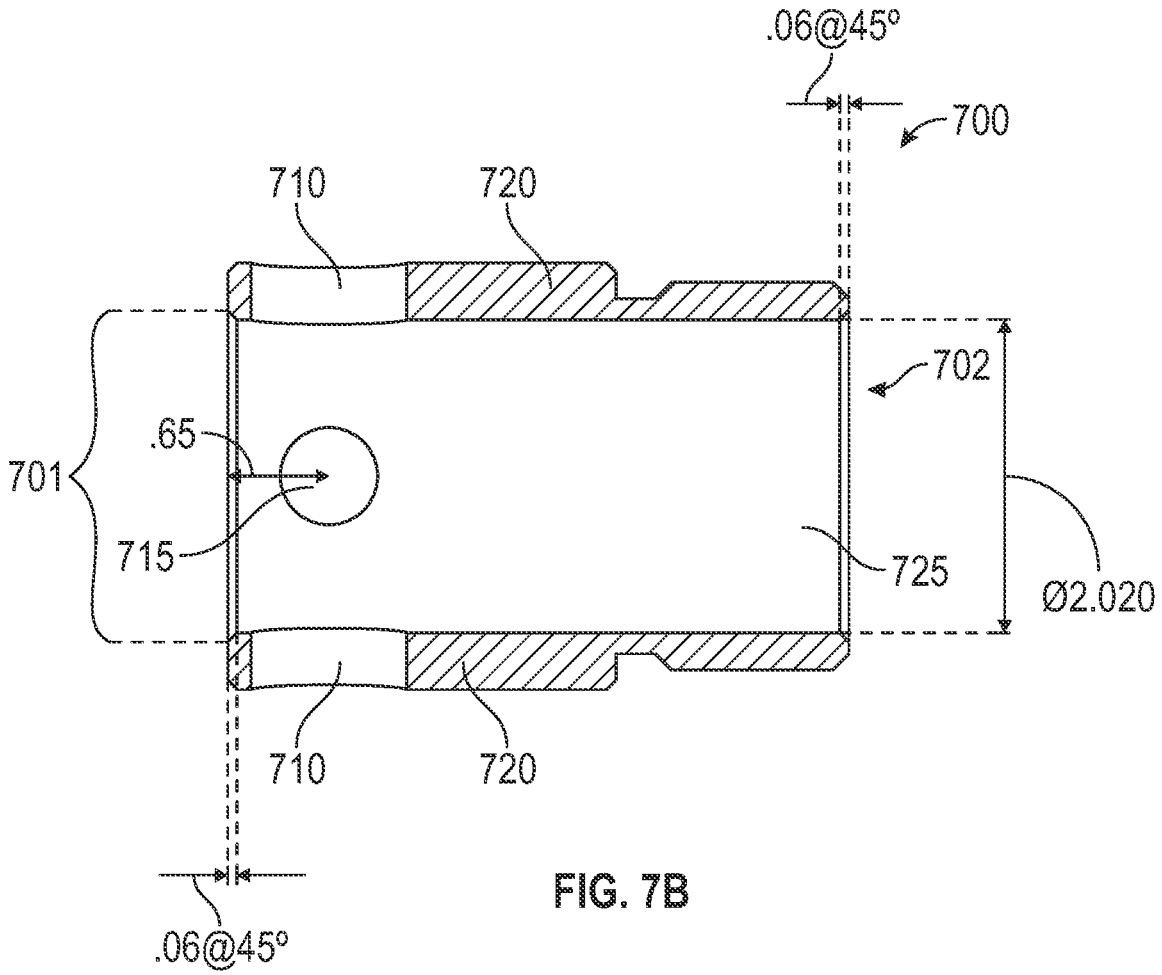
FIG. 7B is a side cross-section view of a sleeve adapter of a wireline setting assembly.
Figure 7C:
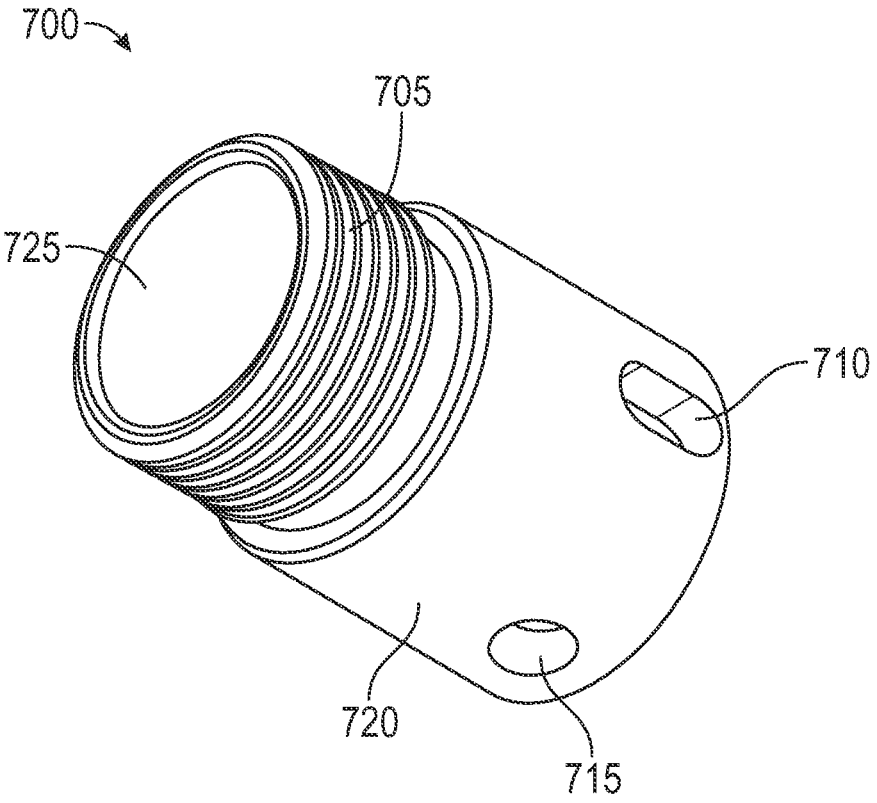
FIG. 7C is a perspective view of a sleeve adapter of a wireline setting assembly.

FIGS. 7A, 7B, and 7C depict an embodiment of a sleeve adapter 700. A sleeve adapter 700 is a component that is configured to connect wireline setting assembly 100 to a setting sleeve 950.

Sleeve adapter 700 comprises sleeve adapter top end 701, sleeve adapter bottom end 702, sleeve adapter threads 705, sleeve adapter crosslink slots 710, sleeve adapter crosslink fastener holes 715, sleeve adapter wall 720, and sleeve adapter cavity 725. In an exemplary embodiment, sleeve adapter threads 705 are configured to receive and engage with a setting sleeve 950.

In an exemplary embodiment, sleeve adapter 700 are configured such that sleeve adapter 700 circumferentially surrounds mandrel 400, sleeve adapter cavity 725 is configured to receive mandrel body 420, sleeve adapter crosslink slots 710 are configured to receive crosslink 600, and sleeve adapter crosslink fastener holes 715 are configured to receive crosslink fastener 650. In this exemplary embodiment, sleeve adapter 700 slides along an exterior of mandrel 400 in response to motion of piston 300 as restricted by crosslink 600 sliding in mandrel crosslink slots 425.

In an exemplary embodiment (shown in FIGS. 9A and 9B), sleeve adapter 700 is securely affixed to piston 300 by crosslink fastener 650 being threaded into crosslink fastener receptacle 320, and sleeve adapter 700 is slidably engaged with mandrel 400 by crosslink 600 being inserted through mandrel crosslink slot 425. Thus, when assembled, movement of piston 300 (inside cylinder 200 and mandrel 400 and relative to cylinder 200 and mandrel 400) directly causes motion of sleeve adapter 700 outside of mandrel 400 relative to cylinder 200 and mandrel 400.

Figure 8C:
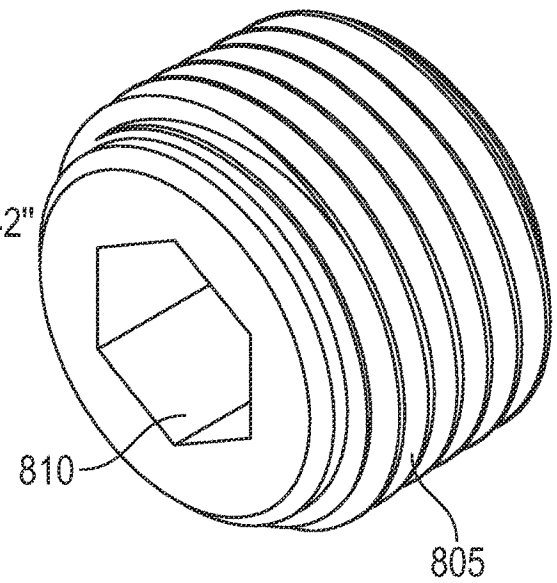
FIG. 8C is a perspective view of an orifice plug of a wireline setting assembly.
Figure 8B:
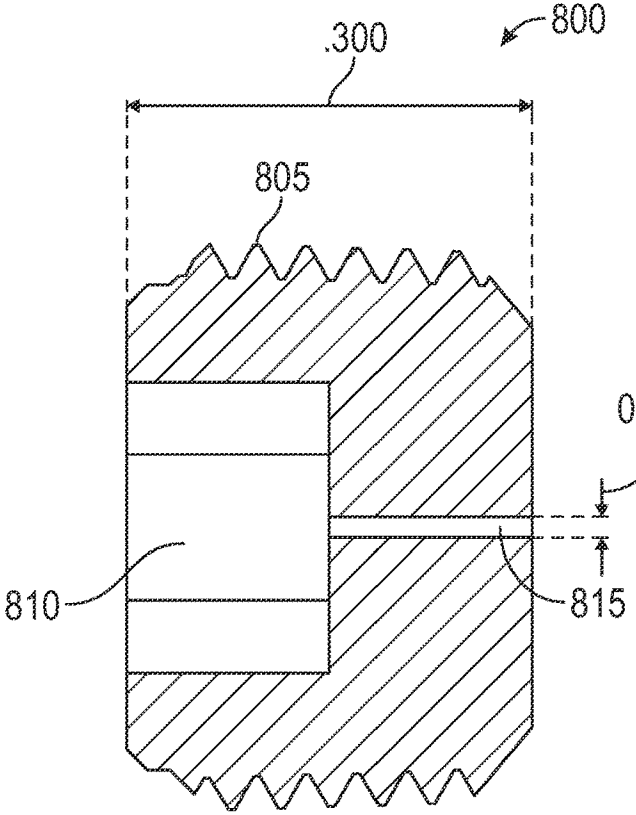
FIG. 8B is a side view of an orifice plug of a wireline setting assembly.
Figure 8A:
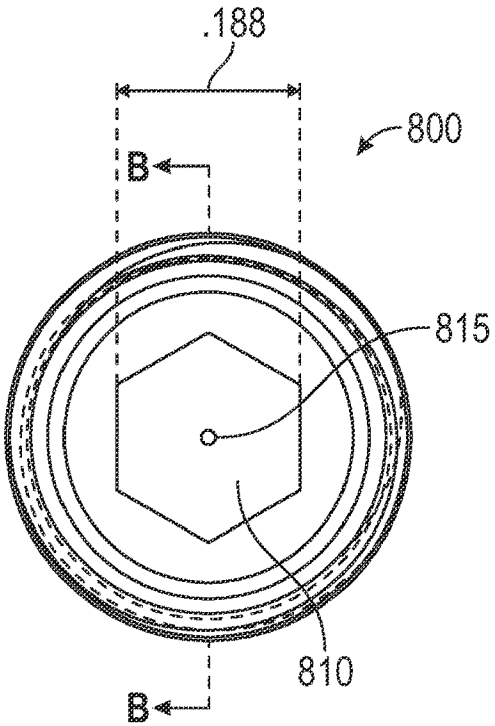
FIG. 8A is a front view of an orifice plug of a wireline setting assembly.

FIGS. 8A, 8B and 8C depict an exemplary embodiment of orifice plug 800. Orifice plug 800 is a threaded cylinder having a length that is approximately the same as orifice 225*a*-*b* and which has a hole through the center. The depicted embodiment of orifice plug 800 comprises orifice plug threads 805, orifice cavity 810, and orifice tube 815. Orifice plug threads 805 and orifices 225*a*-*b* are configured with complimentary threads so that an orifice plug 800 may be threaded into orifice 225*a* or orifice 225*b*. In the depicted embodiment, orifice plug threads 805 are ¼" NPT Pipe Size, 27 TPI with a 0.26" thread engagement. In the depicted embodiment, orifice cavity 810 is a hexagonal cavity for allowing one or more tools to rotate orifice plug 800. Other suitable cavity shapes may be used. Orifice tube 815 is a hole through orifice plug 800. When assembled, orifice tube 815 provides a fluid connection between the outside of cylinder 200 and lower chamber 220 of cylinder 200. As shown in more detail with respect to FIGS. 1A, 9C and 9D, when wireline setting assembly 100 is lowered into casing 140 within a borehole, annular fluid 145 within casing 140 flows through orifice tube 815 into lower chamber 220 below o rings 350 on piston head 305; and, when engaged, movement of piston 300 pushes annular fluid 145 out of lower chamber 220 through orifice tube 815. Thus, the annular fluid 145 flowing out of orifice tube 815 resists the motion of piston 300, and changing the size of orifice tube 815 can change the amount of such resistance. In an exemplary embodiment, orifice tube 815 is laser drilled to be a cylinder having a diameter of approximately 0.042 inches.

Other suitable sizes of orifice tube 815 may be used. For example, casing 140 having a larger size may have larger tool elastomer packing elements which require more time to energize the elastomer. Because packing elements are energized by pressure provided by a setting charge 970 and because the duration that wireline setting assembly 100 engages a tool 150 is related to the flow of annular fluid 145 out of orifice tube 815, a smaller orifice tube 815 will increase the duration of engagement of wireline setting assembly 100 and may be suitable for certain types of casings 140 requiring a longer time to become energized. In this context, the term "energize" means pressure on an elastomer causing that elastomer to set.

For example, we speculate that, while a typical orifice tube 815 diameter is approximately 0.042 inches, the orifice tube 815 diameter may be anywhere from approximately 0.010 inches to approximately 0.055 inches or any value in between, including approximately 0.011", 0.012", 0.013", 0.014", 0.015", 0.016", 0.017", 0.018", 0.019", 0.020", 0.021". 0.022", 0.023", 0.024", 0.025", 0.026". 0.027", 0.028", 0.029", 0.030", 0.031", 0.032", 0.033", 0.034", 0.035", 0.036", 0.037", 0.038", 0.039", 0.040", 0.041", 0.042". 0.043", 0.044", 0.045", 0.046", 0.047". 0.048", 0.049". 0.050", 0.051", 0.052", 0.053", 0.054", or 0.055". Larger sizes may be used. However, sizes below 0.055" are preferred.

We speculate that using an orifice 225*a*-*b* and orifice plugs 800 provides benefits, including: (a) replacement of orifice plug 800 if repeated use of wireline setting assembly 100 causes wear on orifice tube 815 changing resistance to an unacceptable level; and (b) changing the performance of wireline setting assembly 100 by using orifice plugs 800 having orifice tubes 815 of varying sizes.

Figure 9A:
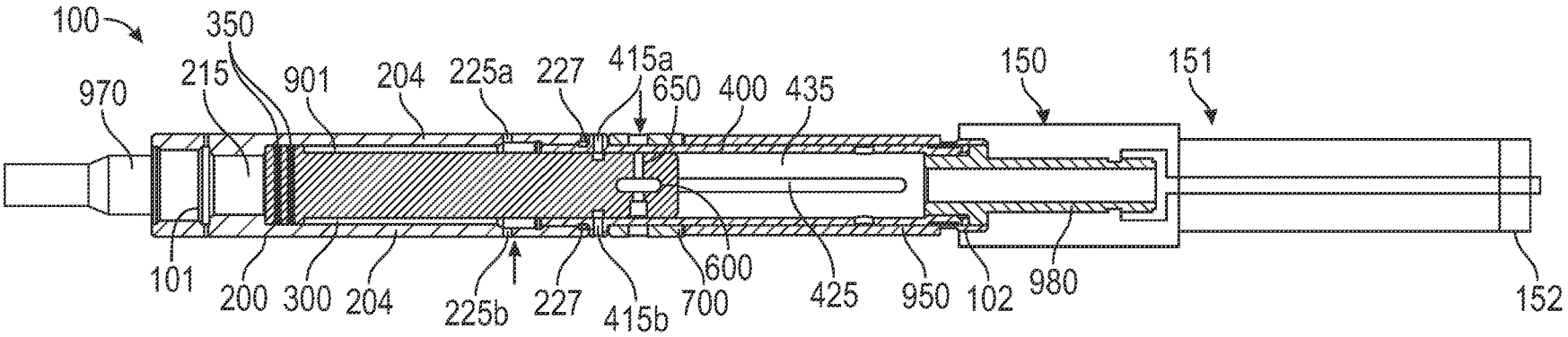
FIG. 9A is a side cross section view of a wireline setting assembly before engagement, configured with a setting charge for creating pressure to cause engagement.
Figure 9B:
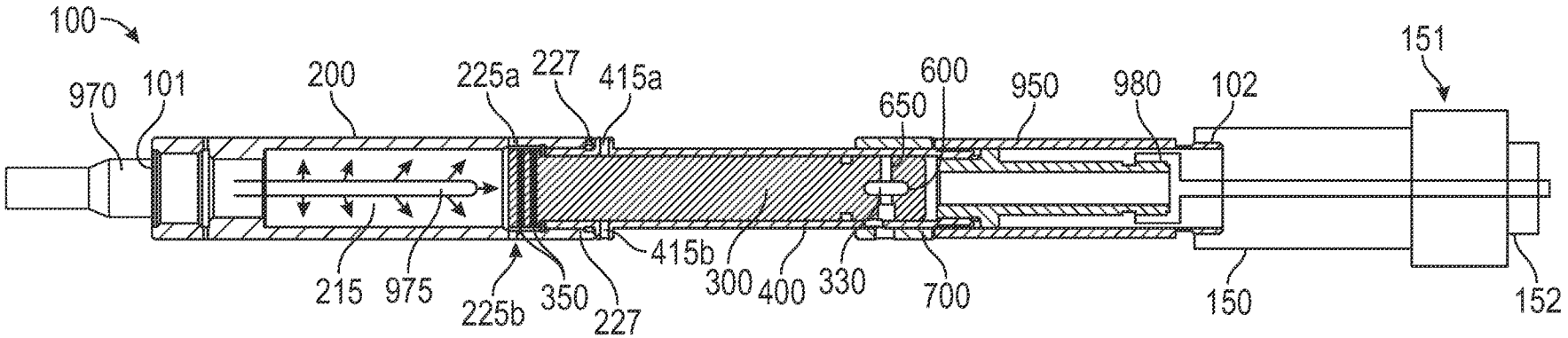
FIG. 9B is a side cross section view of a wireline setting assembly after engagement, configured with a setting charge that has created pressure and thereby caused engagement.

FIGS. 9A and 9B show an exemplary embodiment of wireline setting assembly 100 before engagement (FIG. 9A) and after engagement (FIG. 9B). These figures show wireline setting assembly top end 101 and wireline setting assembly bottom end 102.

This embodiment of wireline setting assembly 100 also shows setting charge 970 and, in FIG. 9B, charge gas 975. Setting charge 970 is an industry standard setting charge, also known as a power charge, such as those offered by Baker Hughes (e.g., Power Charge—Slow Set—E4 #10). As understood by those skilled in the art, a setting charge, or a power charge, is an explosive device that is designed to be triggered by wireline and which produces charge gas 975. In this exemplary embodiment, triggering of setting charge 970 by wire 115 causes setting charge 970 to release charge gas 975, thereby creating pressure in upper chamber 215 of cylinder 200, thereby moving piston 300 away from wireline setting assembly top end 101.

FIGS. 9A and 9B also show setting sleeve 950, which is an industry standard setting sleeve selected from commercially available products to work with a particular embodiment of wireline setting assembly 100. In this embodiment, setting sleeve 950 is threaded into sleeve adapter threads 705 and is securely affixed to sleeve adapter 700. Thus, the relative motion of piston 300 causing motion of sleeve adapter 700 also causes motion of setting sleeve 950 (i.e., second group of components 195) relative to assembly of cylinder 200, mandrel 400 and tool adapter 980 (i.e., first group of components 190). However, while the motion may be thought of as relative motion, in practice, it is first group of components 190 that moves, while second group of components remain in a fixed position.

FIGS. 9A and 9B also show tool adapter 980. Tool adapter 980 is an adapter with threads on a top end configured to threadedly affix to mandrel bottom threads 445 and with threads on a bottom end to threadedly affix to a tool 150.

When used in downhole operations, setting sleeve 950 rests on and directly above tool 150 within casing 140 and tool adapter 980 is threadedly affixed to tool 150. Because tool 150 is designed pursuant to American Petroleum Institute Standard 11D1, tool 150 is designed to engage when a pulling force is applied. This pulling force is created by cylinder 200, mandrel 400, and tool adapter 980 moving away from tool 150, pulling upward on tool 150. This motion might alternatively be viewed as motion of piston 300 relative to cylinder 200. However, because of how wireline setting assembly is placed on top of tool 150, piston 300, sleeve adapter 700, and setting sleeve 950 remain fixed relative to tool 150 and cylinder 200, mandrel 400, and tool adapter 980 move upwards within casing 140.

In other words, when wireline setting assembly 100 is engaged: (1) piston 300 moves relative to cylinder 200 but piston 300, sleeve adapter 700, and setting sleeve 950 stay in a fixed position relative to tool 150; and (2) cylinder 200, mandrel 400, and tool adapter 980 move relative to tool 150 (i.e., in typical embodiments, towards the surface of the earth).

The foregoing description of motion results in the position changes shown in FIGS. 9A and 9B, as well as the motion shown in FIGS. 1A and 1B. The same or similar motion is occurring in both sets of figures.

Because piston 300, sleeve adapter 700, and setting sleeve 950 stay fixed relative to tool 150 and because cylinder 200, mandrel 400, and tool adapter 980 move upward relative to tool 150 and because tool adapter 980 is threadedly affixed to tool 150, engagement of wireline setting assembly 100 and motion of tool adapter 980 pulls upward on tool 150 at the location where tool adapter 980 is threadedly affixed to tool 150, thereby causing engagement of tool 150. In the exemplary embodiment of FIGS. 9A and 9B, this engagement of tool 150 is demonstrated by tool adapter 980 pulling on tool endcap 152 squeezing tool expanding member 151 thereby causing tool expanding member 151 to permanently deform, expanding perpendicular to the axis of casing 140 and contracting parallel with the axis of casing 140.

FIG. 9A also shows annular fluid cavity 901. Annular fluid cavity 901 is a cavity formed between cylinder wall 204 and piston body 310. In the depicted embodiment, annular fluid cavity is a portion of lower chamber 220.

Figure 9C:
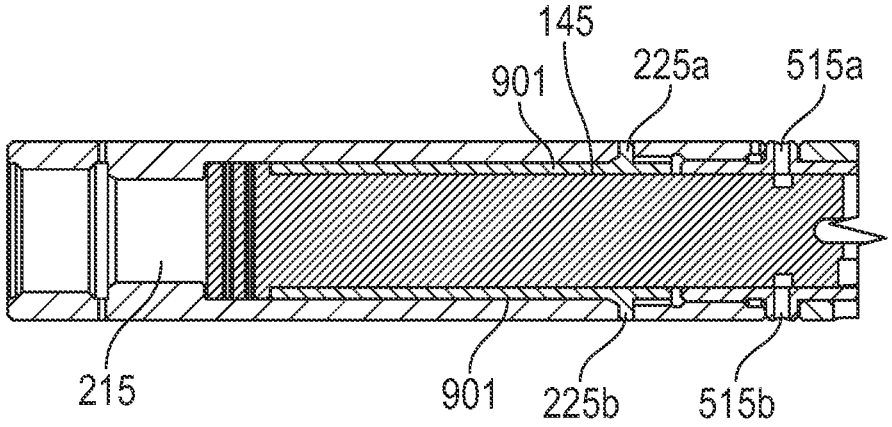
FIG. 9C is a side cross section detail view of a wireline setting assembly before engagement showing annular fluid inside the wireline setting assembly before engagement.

FIG. 9C depicts annular fluid 145 inside annular fluid cavity 901.

As discussed above, in exemplary embodiments, annular fluid 145 flows through each orifice tube 815 in each orifice plug 800 in each orifice 225*a*-225*b* into annular fluid cavity 901 and motion of piston 300 during engagement of wireline setting assembly 100 causes annular fluid 145 to be pushed out of annular fluid cavity 901 through each orifice tube 815 in each orifice plug 800 in each orifice 225*a*-225*b*.

Figure 9D:
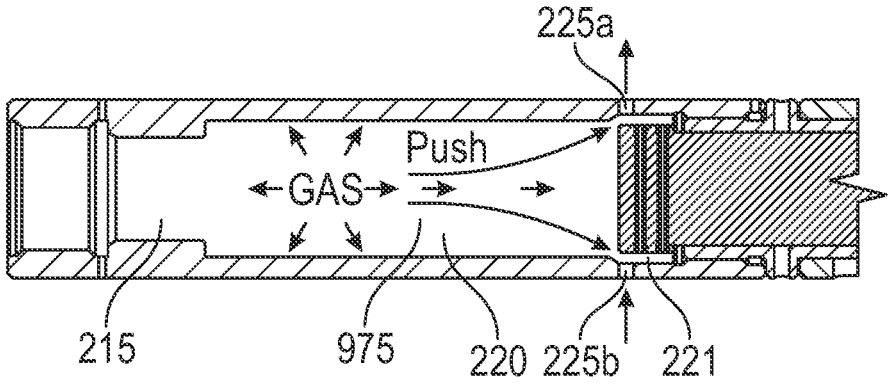
FIG. 9D is a side cross section detail view of a wireline setting assembly after engagement showing annular fluid pushed out of the wireline setting assembly and also showing pressurized gas being released from the wireline setting assembly.
Figure 10A:
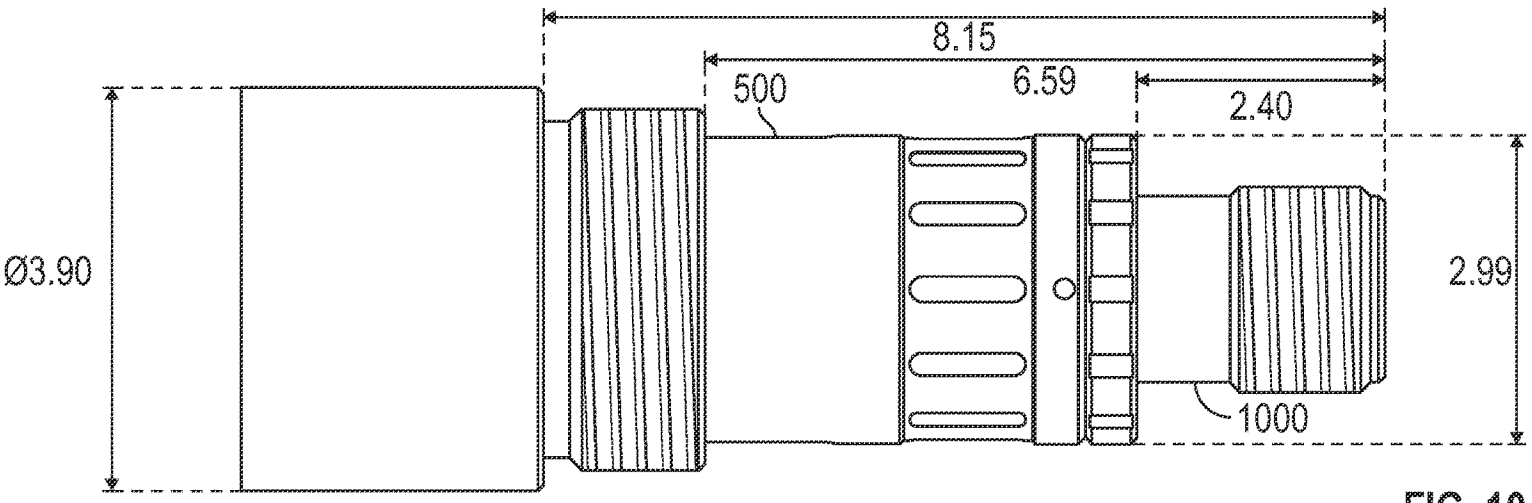
FIG. 10A shows a side view of a tool adapter installed in a bottom end of a mandrel of a wireline setting assembly.
Figure 10B:
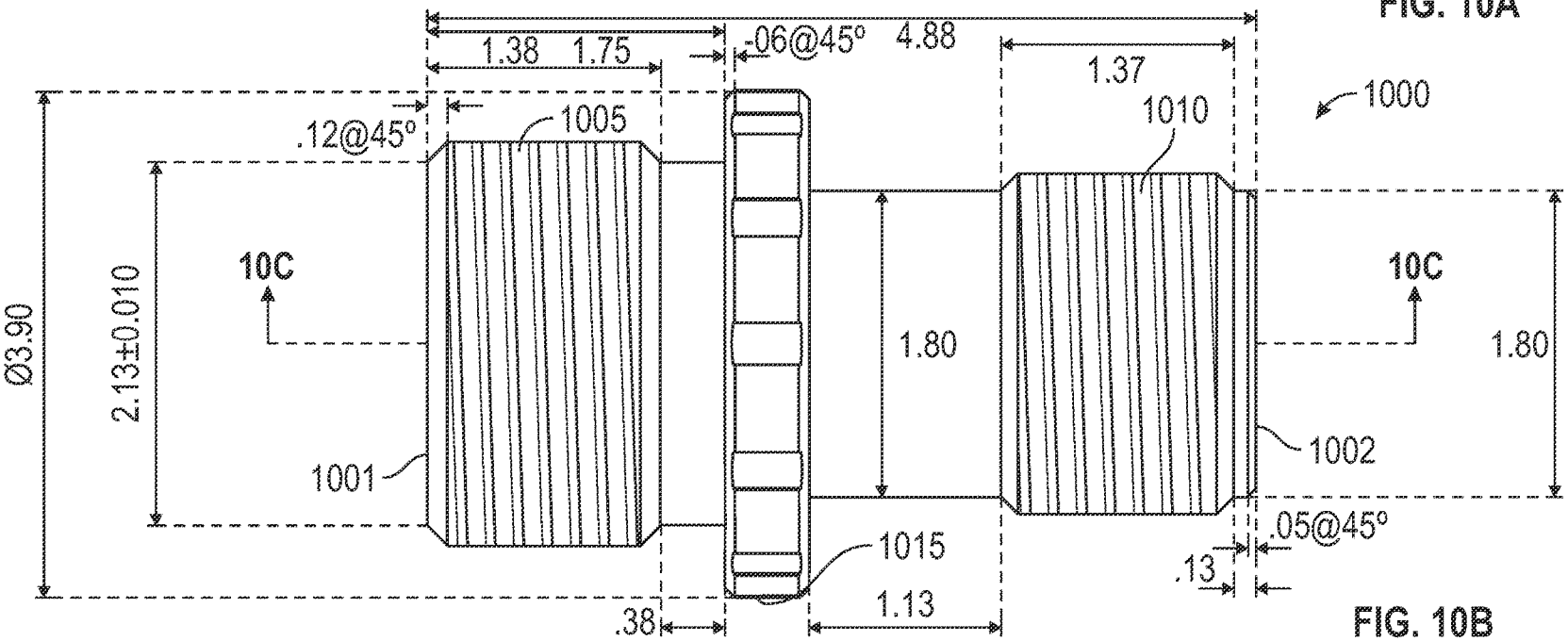
FIG. 10B is a side view of a tool adapter of a wireline setting assembly.
Figure 10C:
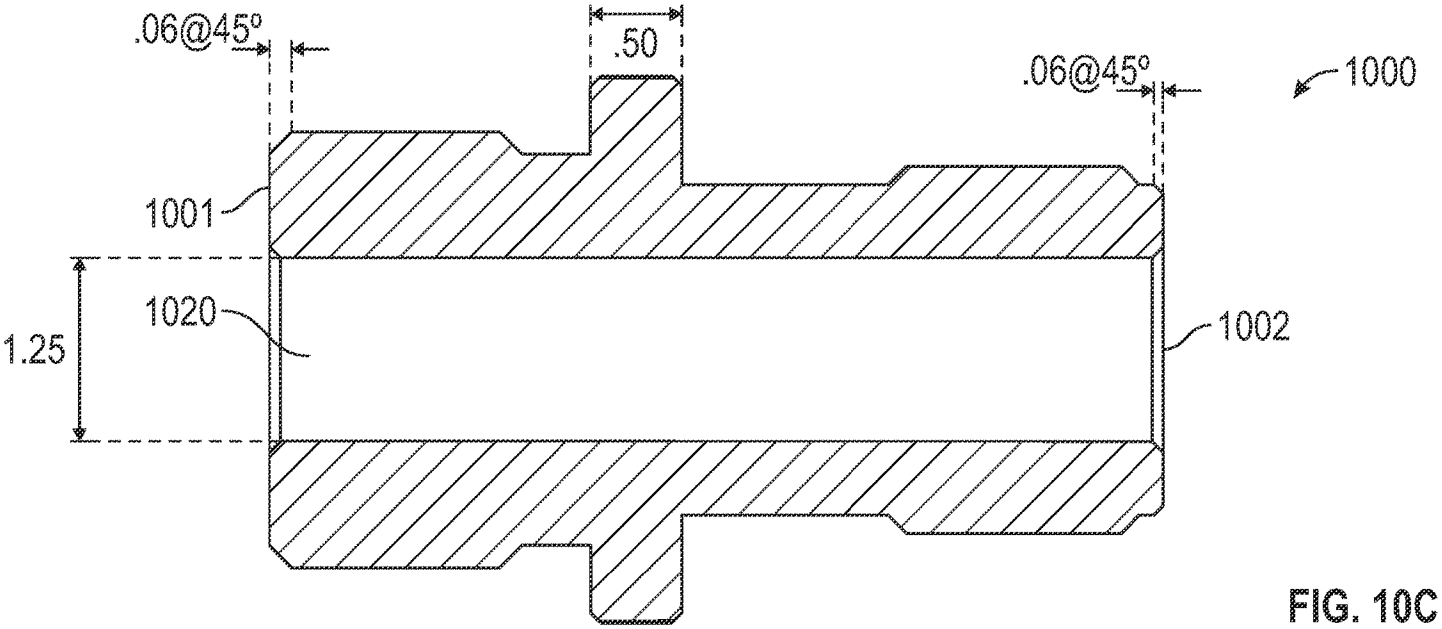
FIG. 10C is a side cross-section view of a tool adapter of a wireline setting assembly.
Figure 10D:
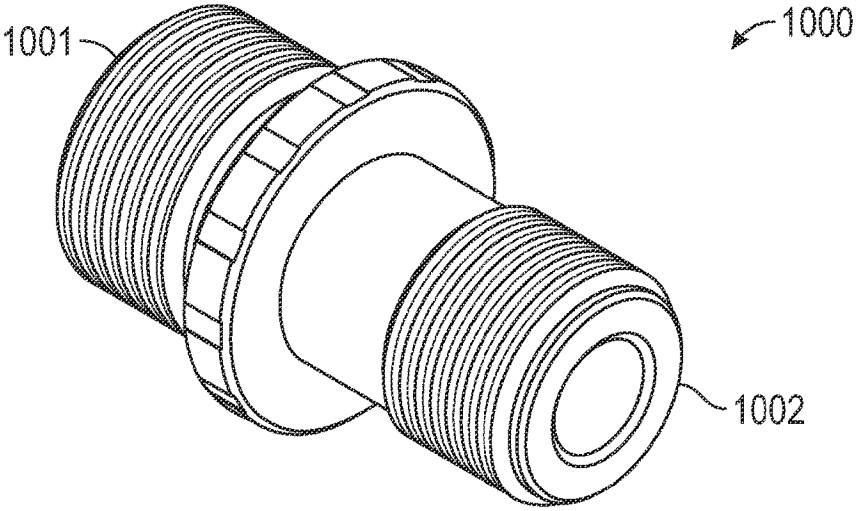
FIG. 10D is a perspective view of a tool adapter of a wireline setting assembly.

FIG. 9D depicts an exemplary embodiment of wireline setting assembly 100 after being fully engaged and during post-engagement depressurization.

As discussed above, o rings 350 on piston head 305 create an airtight seal that is capable of blocking fluid communication between areas on either side of the airtight seal. The upper side of the airtight seal includes upper chamber 215 and portions of lower chamber 220, varying with the position of piston head 305, that are between upper chamber 215 and o rings 350. The lower side of the airtight seal includes areas in lower chamber 220 that are on the other side of o rings 350 from the upper side of the airtight seal. This airtight seal blocking fluid communication blocks charge gas 975 created in upper chamber 215 from passing o rings 350 (and therefore blocks charge gas 975 from flowing into the lower side of the airtight seal) and also blocks annular fluid 145 in annular fluid cavity 901 from passing o rings 350 (and therefore blocks annular fluid 145 from flowing into the upper side of the airtight seal). In other words, charge gas 975 expands in upper chamber 215 and pushes against piston head 305. As piston head 305 moves relative to cylinder 200, piston head 305 pushes annular fluid 145 out of orifices 225*a*-225*b*. Once piston head 305 moves a sufficient distance, orifices 225*a*-225*b* become fluidly connected to upper chamber 215 and charge gas 975 flows out of cylinder 200, thereby resulting in an automatic release of pressure.

In some embodiments, orifices 225*a*-225*b* become fluidly connected to upper chamber 215 when piston head 305 moves into lower chamber expansion 221. In these embodiments, the airtight seal of o rings 350 is broken when the o rings 350 move in lower chamber 220 into lower chamber expansion 221 because lower chamber expansion 221 has a larger inner diameter. In other words, as piston 300 moves relative to cylinder 200, piston head 305 moves from lower chamber 220 fully into lower chamber expansion 221. When piston head 305 moves into lower chamber expansion 221, the increased diameter is such that o rings 350 no longer create an airtight seal against chamber wall 204. Thus, once all of the o rings 350 on piston head 305 move fully into lower chamber expansion 221, upper chamber 215 and lower chamber 220 (including lower chamber expansion 221) are in fluid connection. When this happens, charge gas 975 can move from upper chamber 215 (an area of higher pressure) into lower chamber 220 and into lower chamber expansion 221 and then through each orifice tube 815 in each orifice plug 800 in each orifice 225*a*-225*b* and into casing 140 (areas of lower pressure). In this fashion, after pressure is created inside upper chamber 215 causing motion of piston 300, that pressure is automatically released once wireline setting assembly 100 fully engages causing full extension of piston 300 (i.e., piston head 305 moves fully into lower chamber expansion 221).

In our opinion, the device disclosed herein is an improvement over other devices for several reasons. One reason is that the device disclosed herein is shorter and lighter than other devices. Another reason is because it can be redressed in less than ten minutes, which is shorter than other devices. Another reason is due to the automatic pressure bleeding after engagement. Another reason is that prior devices use the flow of oil inside such prior devices to slow internal motion caused by a setting charge 975. In our opinion, this slowing of internal motion is without control or concern for time (duration of engagement) and with no concern for casing size or amount of elastomer to be energized. While the slower rate of motion caused by the internal flow of oil is desirable, the use of oil causes problems because of thermal expansion, because resetting the prior devices becomes messy, and because it creates environmental issues and additional time and cost to clean. Additionally, oil needs to be replaced, thereby increasing the cost and complexity of using such prior tools. One way other devices have attempted to solve the problems associated with using oil is to slow internal motion of such other devices by using the flow of air or one or more gases. However, in our opinion the flow of air or gas is difficult to control in small volumes and the flow of such air or gas inside such devices does not sufficiently slow the internal motion of such devices. Furthermore, we speculate that when motion is not sufficiently slowed by air or gas, the resulting rapid motion of such devices causes broken devices, broken tools, or tools not operating properly. For example, casing of a borehole may break, be blocked, or may not properly set by tools with internal motion slowed by the flow of air. The device disclosed herein solves these problems while still maintaining sufficient power. For example, when using a #20 standard/slow burn power charge, embodiments of the disclosed device are capable of producing 100,000 pounds of force.

FIGS. 10A, 10B, 10C, and 10D depict an exemplary embodiment of alternative tool adapter 1000 connected to alternative mandrel 500. Alternative tool adapter 1000 is an alternative embodiment of tool adapter 980. In this exemplary embodiment, alternative tool adapter 1000 comprises alternative tool adapter top end 1001, alternative tool adapter bottom end 1002, alternative tool adapter top threads 1005, alternative tool adapter bottom threads 1010, alternative tool adapter grip 1015, and alternative tool adapter cavity 1020. In this exemplary embodiment, alternative tool adapter top threads 1005 are configured to thread into mandrel bottom threads 445 of alternative mandrel 500, and alternative tool adapter bottom threads 1010 are configured to thread into threads of tool 150.

Figure 11A:
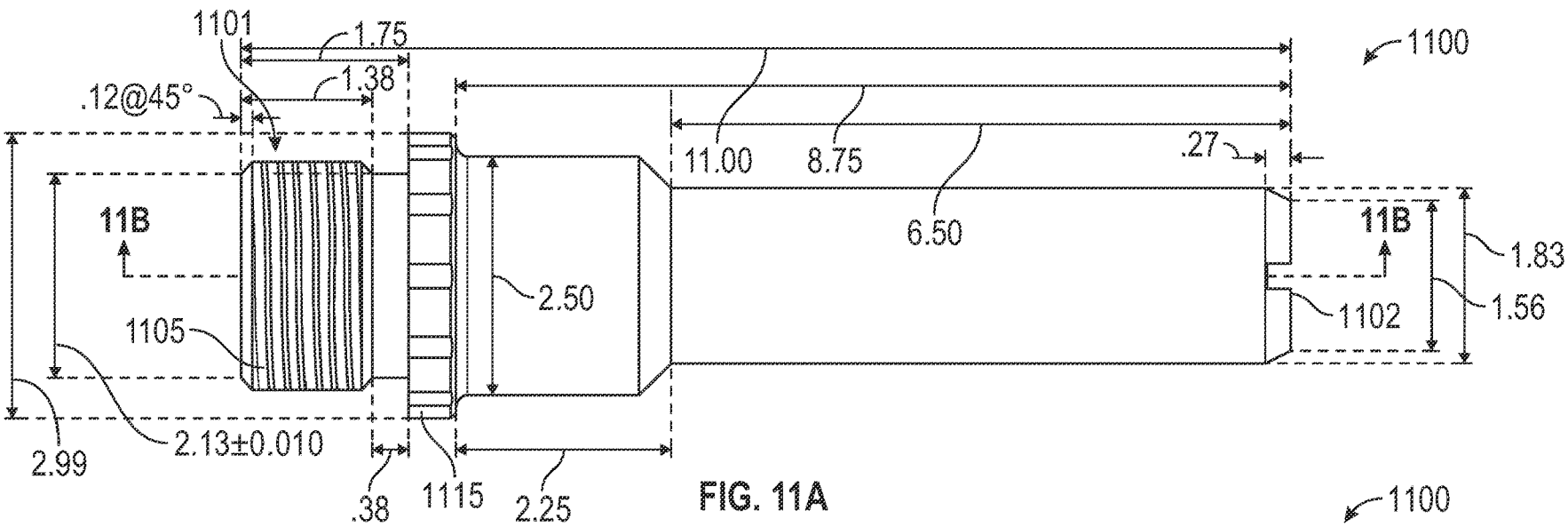
FIG. 11A is a side view of a tool adapter of a wireline setting assembly.
Figure 11B:
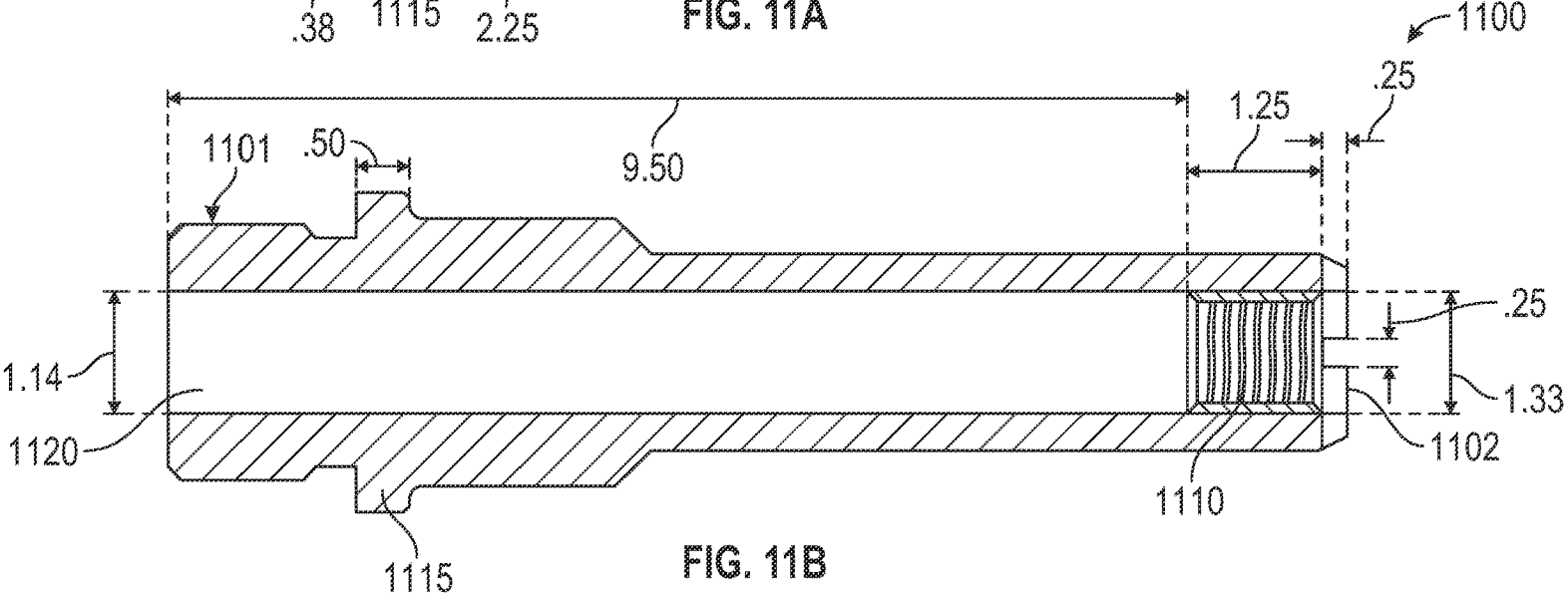
FIG. 11B is a side cross-section view of a tool adapter of wireline setting assembly.

FIGS. 11A and 11B depict an exemplary embodiment of second alternative tool adapter 1100. Second alternative tool adapter 1100 is another alternative embodiment of tool adapter 980. In this exemplary embodiment, second alternative tool adapter 1100 comprises second alternative tool adapter top end 1101, second alternative tool adapter bottom end 1102, second alternative tool adapter top threads 1105, second alternative tool adapter bottom threads 1110, second alternative tool adapter grip 1215, and second alternative tool adapter cavity 1220.

Tool adapter 980, alternative tool adapter 1000, and second alternative tool adapter 1100 are each used as adapters to connect mandrel 400 or alternative mandrel 500 to various embodiments of tool 150.

Figure 12:
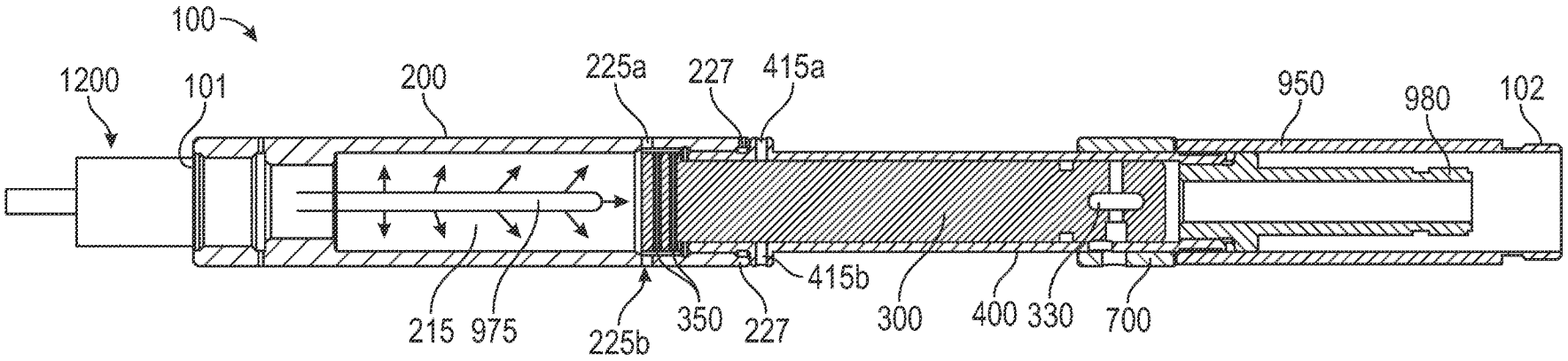
FIG. 12 is a side cross-section view of a wireline setting assembly connected to a downhole motor for creating pressure or motion to engage the wireline setting assembly.

FIG. 12 depicts an alternative embodiment of wireline setting assembly 100 connected to a downhole motor 1200. Downhole motor 1200 is an industry standard device that uses motion of annular fluid 145 (or other downhole fluids) inside casing 140 to create a rotational force. This rotational force can create pressure. In the embodiment depicted in FIG. 12, wireline setting assembly 100 uses downhole motor 1200 to move piston 300 inside upper chamber 215 instead of setting charge 970. Some embodiments using downhole motor 1200 may use downhole motor 1200 to create gas pressure inside upper chamber 215 and other embodiments may use downhole motor 1200 to mechanically move piston 300. In these embodiments, motion of annular fluid 145 moves components of downhole motor 1200 and downhole motor 1200 in turn creates internal air, gas, or fluid pressure within upper chamber 215 to move the piston 300 as an alternative to a setting charge 970.

Figure 2A:
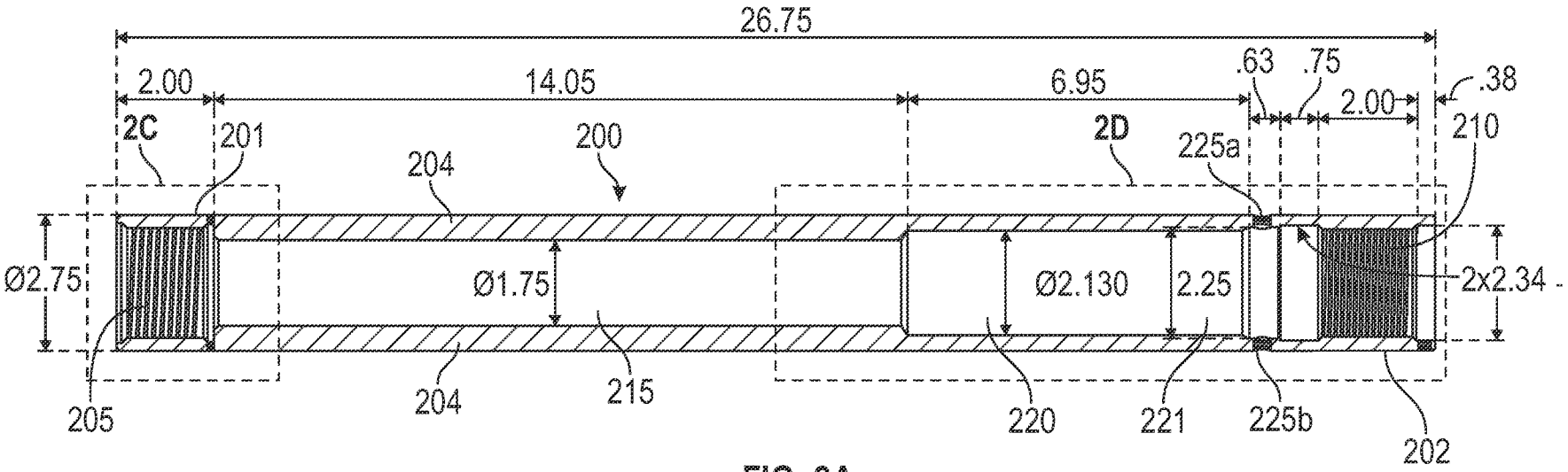
FIG. 2A is a side cross-section view of a cylinder of a wireline setting assembly.
Figure 2B:
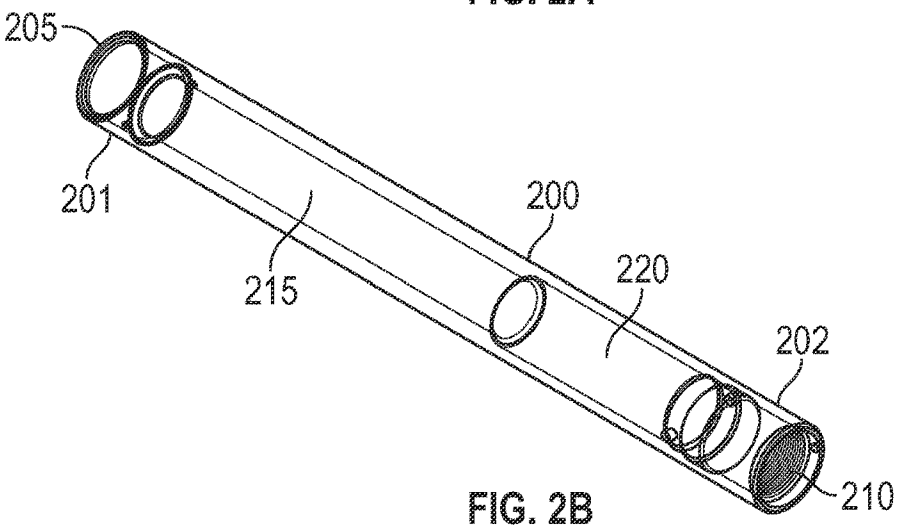
FIG. 2B is a perspective view of a cylinder of a wireline setting assembly.
Figure 2C:
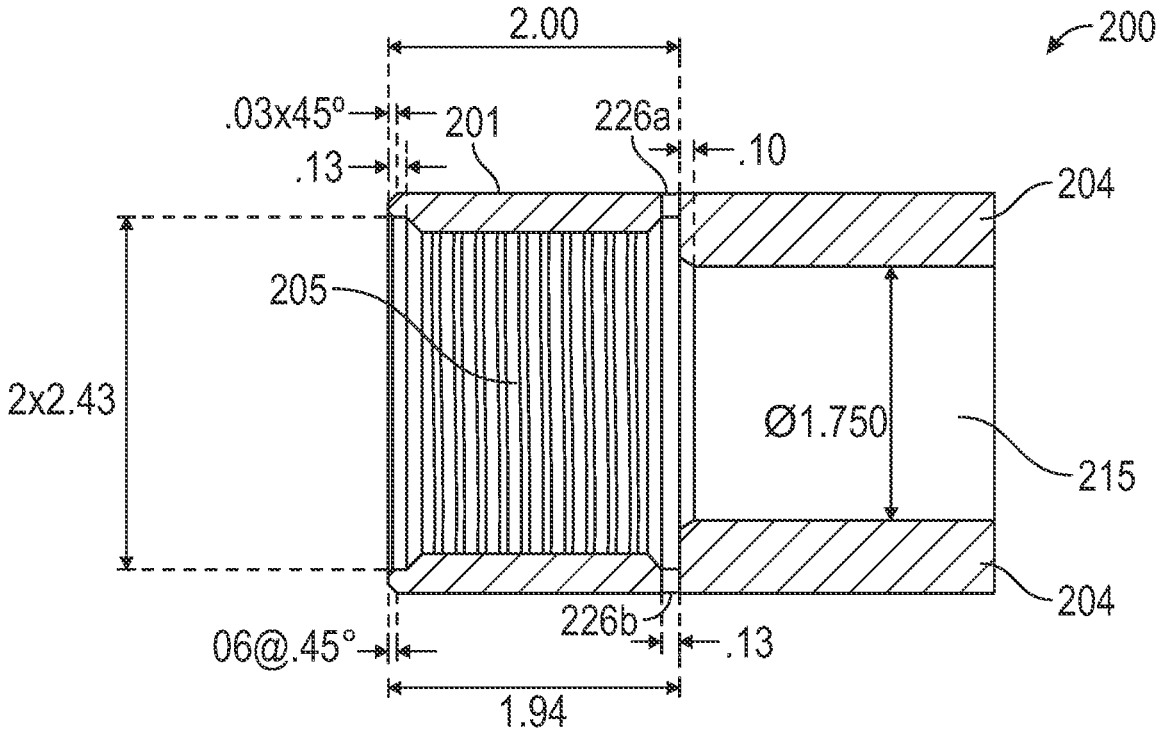
FIG. 2C is a side cross-section detail view of a top end of a cylinder of a wireline setting assembly.
Figure 2D:
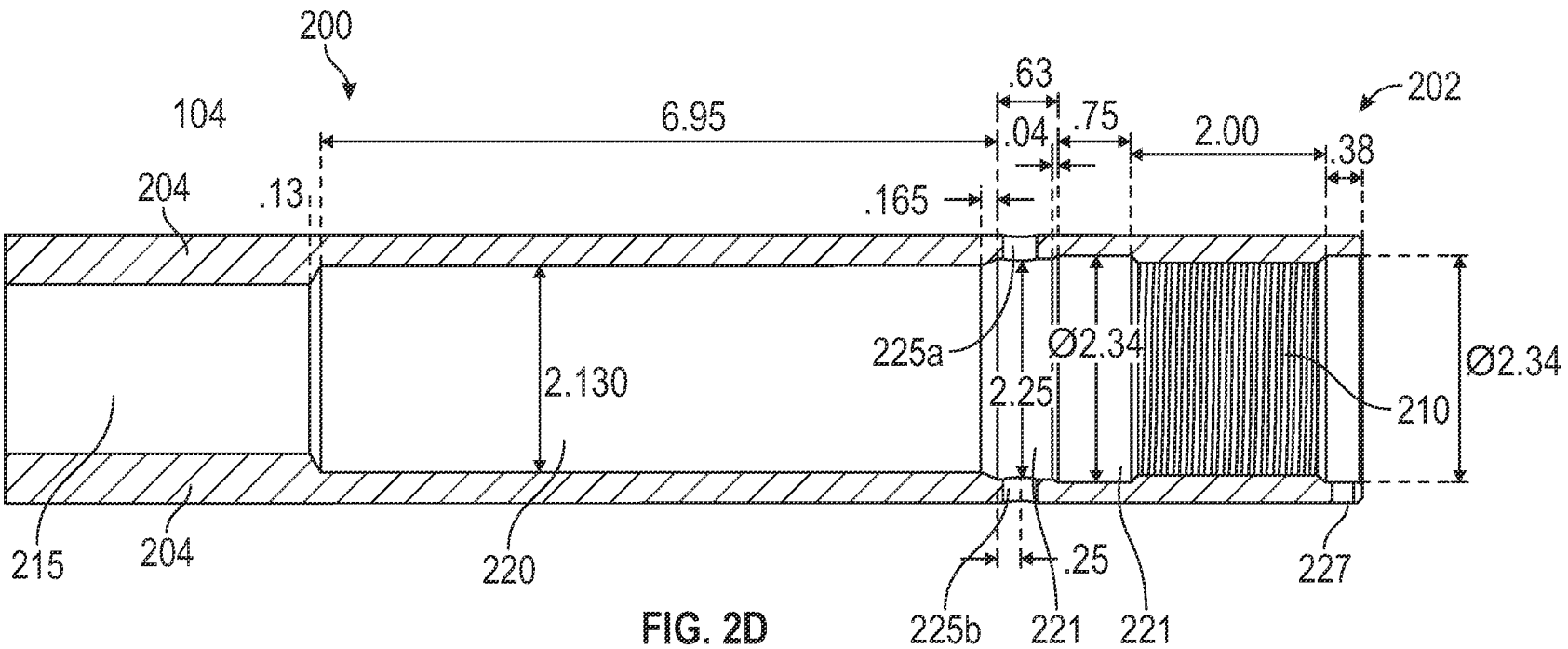
FIG. 2D is a side cross-section detail view of a bottom end of a cylinder of a wireline setting assembly.

As shown in FIGS. 2A-2D, 9A-9D, and 13, various embodiments of wireline setting assembly 100 have upper chambers 215 with varying axial lengths. FIGS. 9A-9D and 13A-13B show embodiments with a shorter upper chamber 215, whereas FIGS. 2A-2C show embodiment with a larger upper chamber 215.

Embodiments having upper chambers 215 that are longer allow setting charge 970 to be inserted deeper into upper chamber 215, whereas embodiments having upper chambers 215 that are shorter are configured so that more of, and in some cases all of, setting charge 970 sits outside wireline setting assembly 100.

Figure 13A:
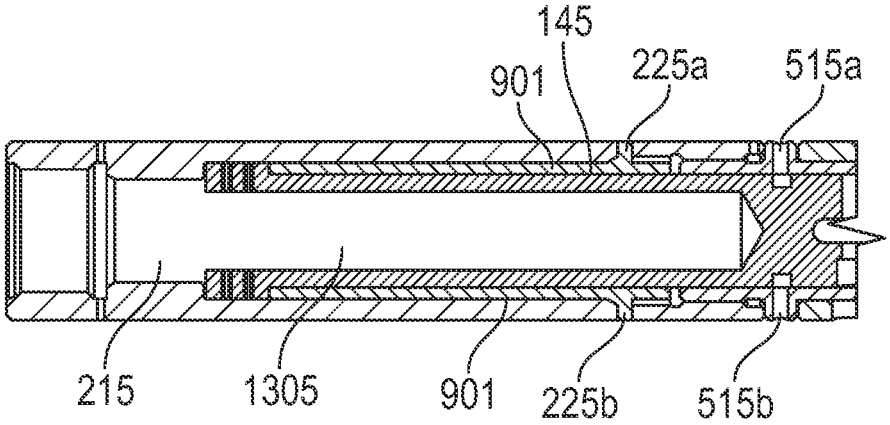
FIG. 13A is a side cross-section view of a wireline setting assembly showing a piston cavity before said wireline setting assembly is engaged.
Figure 13B:
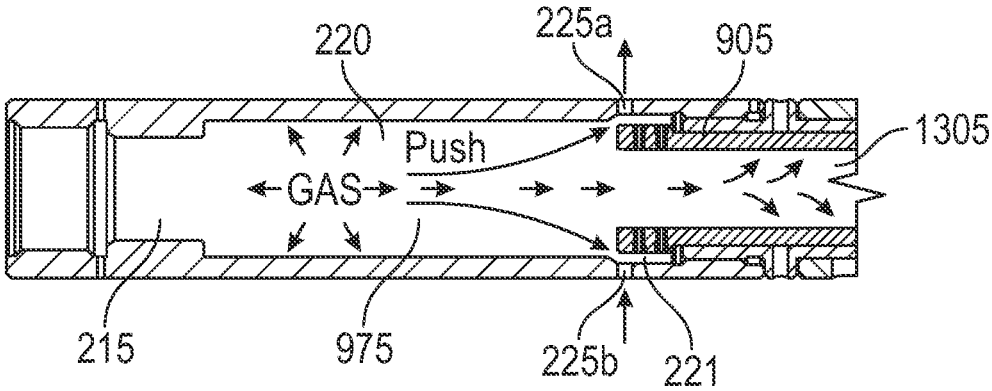
FIG. 13B is a side cross-section view of a wireline setting assembly showing a piston cavity when said wireline setting assembly is engaged.

FIGS. 13A and 13B show an alternative embodiment of cylinder 200 and piston 300 where upper chamber 215 has a shorter axial length and piston 300 further comprises piston cavity 1305. One way of viewing this configuration is that piston cavity 1305 effectively extends the size of upper chamber 215. In this depicted embodiment, piston cavity 1305 is fluidly connected to upper chamber 215. When wireline setting assembly is engaged (FIG. 13B), piston cavity 1305 also becomes fluidly connected to portions of lower cavity 220 as cylinder 200 and piston 300 move apart. In this embodiment, charge gas 975 to expands and push against piston 300 by creating pressure in upper chamber 215 and in piston cavity 1305. In embodiments without piston cavity 1305, setting charge 970 is placed in upper chamber 215. However, in the embodiment of FIGS. 13A and 13B, setting charge 970 may be placed in piston cavity 1305, although setting charge 970 may extend partially into upper chamber 215 depending on the size of piston cavity 1305 and setting charge 970.

In some embodiments where the diameter of piston 300 is large enough, piston cavity 1305 is big enough to receive the entirety of setting charge 970, piston cavity 1305 serves the functional purpose of upper chamber 215, and upper chamber 215 is nonexistent or nearly nonexistent. In other words, in these embodiments, setting charge 970 sits inside piston cavity 300; and, when setting charge 970 expels charge gas 975, charge gas creates pressure in piston cavity 1305 and causes the same engagement actions discussed above, with upper chamber 215 being nonexistent or nearly nonexistent. In these embodiments, the overall length of wireline setting assembly 100 can be reduced, thereby also reducing weight. In our opinion, this reduction in length and weight allows the wireline setting assembly 100 to be easier to handle, movable by one person, and less likely to cause injury.

Cylinder 200, piston 300, mandrel 400, alternative mandrel 500, crosslink 600, crosslink fastener 650, sleeve adapter 700, orifice plugs 800, alternative tool adapter 1000, and second alternative tool adapter 1100 and other screws or pins attached thereto are, in one preferred embodiment, made of 4140 stainless steel. However, other suitable materials may be used.

| Parts List: | |
|---|---|
| wireline setting assembly | 100 |
| wireline setting assembly top end | 101 |
| wireline setting assembly bottom end | 102 |
| wireline detonator | 110 |
| Wire | 115 |
| Hole | 140 |
| annular fluid | 145 |
| Tool | 150 |
| Tool expanding member | 151 |
| Tool endcap | 152 |
| First group of components | 190 |
| Second group of components | 195 |
| Cylinder | 200 |
| cylinder top end | 201 |
| cylinder bottom end | 202 |
| cylinder wall | 204 |
| cylinder top threads | 205 |
| cylinder bottom threads | 210 |
| upper chamber | 215 |
| lower chamber | 220 |
| Lower chamber expansion | 221 |
| Orifice | 225a-b |
| Charge setting threads | 226a-b |
| Mandrel setting threads | 227 |
| Piston | 300 |
| piston top end | 301 |
| piston bottom end | 302 |
| piston head | 305 |
| first groove | 306 |
| second groove | 307 |
| piston body | 310 |
| crosslink fastener receptacle | 320 |
| crosslink receptacle | 330 |
| o ring | 350 |
| mandrel | 400 |
| mandrel top end | 401 |
| mandrel bottom end | 402 |
| mandrel top threads | 405 |
| mandrel ring | 410 |
| anti-preset shear pin threaded receivers | 415a-b |
| mandrel body | 420 |
| mandrel access port | 422 |
| mandrel crosslink slot | 425 |
| mandrel tip | 430 |
| mandrel cavity | 435 |
| mandrel wall | 440 |
| mandrel bottom threads | 445 |
| mandrel bottom barrier | 450 |
| mandrel bottom slot | 460 |
| anti-preset shear pins | 470 |
| alternative mandrel | 500 |
| Grip | 570 |
| Flat edges | 575 |
| crosslink | 600 |
| crosslink hole | 610 |
| crosslink fastener | 650 |
| sleeve adapter | 700 |
| sleeve adapter top end | 701 |
| sleeve adapter bottom end | 702 |
| sleeve adapter threads | 705 |
| sleeve adapter crosslink slots | 710 |
| sleeve adapter crosslink fastener holes | 715 |
| sleeve adapter wall | 720 |
| sleeve adapter cavity | 725 |
| orifice plug | 800 |
| orifice plug threads | 805 |
| orifice cavity | 810 |
| orifice tube | 815 |
| annular fluid cavity | 901 |
| setting sleeve | 950 |
| setting charge | 970 |
| charge gas | 975 |
| tool adapter | 980 |
| alternative tool adapter | 1000 |
| alternative tool adapter top end | 1001 |
| alternative tool adapter bottom end | 1002 |
| alternative tool adapter top threads | 1005 |
| alternative tool adapter bottom threads | 1010 |
| alternative tool adapter grip | 1015 |

-continued

| Parts List: | |
|---|---|
| alternative tool adapter cavity | 1020 |
| second alternative tool adapter | 1100 |
| second alternative tool adapter top end | 1101 |
| second alternative tool adapter bottom end | 1102 |
| second alternative tool adapter top threads | 1105 |
| second alternative tool adapter bottom threads | 1110 |
| downhole motor | 1200 |
| second alternative tool adapter grip | 1215 |
| second alternative tool adapter cavity | 1220 |

The claimed invention is:

1. A wireline setting assembly for engaging a downhole tool comprising:

a cylinder, a piston, a mandrel, a sleeve adapter, and a crosslink;

wherein said cylinder comprises a cylinder wall, at least one orifice, and an internal cavity comprising an upper chamber and a lower chamber;

wherein said at least one orifice provides an opening between said lower chamber and an exterior of said cylinder;

wherein said piston comprises a piston head, a piston body, a piston bottom end, and a crosslink receptacle;

wherein said mandrel comprises a mandrel cavity, a first mandrel crosslink slot, and a second mandrel crosslink slot;

wherein said first mandrel crosslink slot and said second mandrel crosslink slot each extend along an axial length of said mandrel;

wherein said sleeve adapter comprises a sleeve adapter cavity, a first sleeve adapter crosslink slot, and a second sleeve adapter crosslink slot;

wherein said mandrel is within said sleeve adapter cavity;

wherein a bottom end of said cylinder is removably fastened to a top end of said mandrel;

wherein said piston head forms an airtight seal against an inner wall of said lower chamber;

wherein said crosslink affixes said sleeve adapter to said piston by extending through said first sleeve adapter crosslink slot, said second sleeve adapter crosslink slot, and said crosslink receptacle;

wherein said crosslink slidably affixes said piston and said sleeve adapter to said mandrel by extending through said first mandrel crosslink slot and said second mandrel crosslink slot;

wherein said crosslink, said piston, and said sleeve adapter are configured to engage in a sliding motion along said axial length;

wherein motion of said piston along said axial length results in said piston head moving between a first location in said lower chamber and a second location in said lower chamber.

2. The wireline setting assembly of claim 1, further comprising an annular fluid cavity between said piston body and said cylinder wall in said lower chamber, and wherein said wireline setting assembly is configured to allow annular fluid to fill said annular fluid cavity when said wireline setting assembly is submerged in said annular fluid.

3. The wireline setting assembly of claim 2, wherein said wireline setting assembly is configured to engage in said sliding motion in response to pressure in said upper chamber.

4. The wireline setting assembly of claim 3 wherein, when said annular fluid is in said annular fluid cavity, flow of said annular fluid out of said annular fluid cavity through said at least one orifice causes a resistance against said sliding motion.

5. The wireline setting assembly of claim 4, wherein said pressure is released through said at least one orifice when said piston head moves to said second location.

6. The wireline setting assembly of claim 5, wherein said lower chamber has a first inner diameter at said first location and said lower chamber has a second inner diameter at said second location, wherein said second inner diameter is larger than said first inner diameter, and wherein said airtight seal becomes disengaged when said piston head moves to said second location.

7. The wireline setting assembly of claim 5, wherein said pressure is created by a setting charge producing charge gas that flows into said upper chamber.

8. The wireline setting assembly of claim 4, wherein each said at least one orifice is configured to receive an orifice plug and each said orifice plug further comprises an orifice plug tube.

9. The wireline setting assembly of claim 8, wherein decreasing a size of each said orifice plug tube increases said resistance.

10. The wireline setting assembly of claim 8, wherein said at least one orifice is two orifices and each said orifice plug tube has a diameter of between approximately 0.010 and 0.055 inches.

11. The wireline setting assembly of claim 4, wherein said sleeve adapter is configured to removably attach to a setting sleeve and said mandrel is configured to removably attach to a tool adapter;

wherein said sliding motion along said axial length causes relative motion of said sleeve adapter and said tool adapter;

wherein said wireline setting adapter is configured to cause engagement of said downhole tool in response to said relative motion.

12. A wireline setting assembly kit comprising:

a cylinder, a piston, a mandrel, a sleeve adapter, and a crosslink;

wherein said cylinder comprises a cylinder wall, at least one orifice, and an internal cavity comprising an upper chamber and a lower chamber;

wherein said at least one orifice provides an opening between said lower chamber and an exterior of said cylinder;

wherein said piston comprises a piston head, a piston body, a piston bottom end, and a crosslink receptacle;

wherein said mandrel comprises a mandrel cavity, a first mandrel crosslink slot, and a second mandrel crosslink slot;

wherein said first mandrel crosslink slot and said second mandrel crosslink slot each extend along an axial length of said mandrel;

wherein said sleeve adapter comprises a sleeve adapter cavity, a first sleeve adapter crosslink slot, and a second sleeve adapter crosslink slot;

wherein said cylinder is configured to receive said piston head;

wherein a bottom end of said cylinder is configured to be removably fastened to a top end of said mandrel;

wherein said sleeve adapter cavity is configured to receive said mandrel;

wherein said cylinder is configured to create an airtight seal between said piston head and an inner wall of said lower chamber;

wherein said sleeve adapter and said piston are configured to be affixed together by said crosslink extending through said first sleeve adapter crosslink slot, said second sleeve adapter crosslink slot, and said crosslink receptacle;

wherein said sleeve adapter, said piston, and said mandrel are configured to be slidably affixed together by said crosslink extending through said first mandrel crosslink slot and said second mandrel crosslink slot;

wherein, when said wireline assembly kit is assembled, said crosslink, said piston, and said sleeve adapter are configured to engage in a sliding motion along said axial length;

wherein motion of said piston along said axial length results in said piston head moving between a first location in said lower chamber and a second location in said lower chamber.

13. The wireline setting assembly kit of claim 12, wherein said piston and said cylinder are configured to create an annular fluid cavity between said piston body and said cylinder wall in said lower chamber, and wherein, when said wireline setting assembly is assembled and submerged in annular fluid, said annular fluid fills said annular fluid cavity.

14. The wireline setting assembly kit of claim 13, wherein, when said kit is assembled, a pressure in said upper chamber causes said sliding motion.

15. The wireline setting assembly kit of claim 14 wherein, when said kit is assembled and when said annular fluid is in said annular fluid cavity, flow of said annular fluid out of said annular fluid cavity through said at least one orifice causes a resistance against said sliding motion.

16. The wireline setting assembly kit of claim 15, wherein, when said kit is assembled, said pressure is released through said at least one orifice when said piston head moves to said second location.

17. The wireline setting assembly kit of claim 16, wherein said lower chamber has a first inner diameter at said first location and said lower chamber has a second inner diameter at said second location, wherein said second inner diameter is larger than said first inner diameter, and wherein, when said kit is assembled, said airtight seal becomes disengaged when said piston head moves to said second location.

18. The wireline setting assembly kit of claim 16, wherein said pressure is created by a setting charge producing charge gas that flows into said upper chamber.

19. The wireline setting assembly kit of claim 15, wherein each said at least one orifice is configured to receive an orifice plug and each said orifice plug further comprises an orifice plug tube.

20. The wireline setting assembly kit of claim 19, wherein said at least one orifice is two orifices and each said orifice plug tube has a diameter of between approximately 0.010 and 0.055 inches.

21. A method of using a wireline setting assembly to engage a downhole tool comprising the steps of:

1) Assembling said wireline setting assembly;

2) Attaching said downhole tool to said wireline setting assembly and placing a setting charge in said wireline setting assembly;

3) Lowering said wireline setting assembly into a casing;

4) Filling said wireline setting assembly with annular fluid in said casing;

5) Engaging said wireline setting assembly by detonating said setting charge;

6) Releasing a pressure caused by said setting charge;

7) Removing said wireline setting assembly from said casing;

8) Disassembling said wireline setting assembly;

wherein said wireline setting assembly comprises a cylinder, a piston, a mandrel, a sleeve adapter, and a crosslink;

wherein said cylinder comprises a cylinder wall, at least one orifice, and an internal cavity comprising an upper chamber and a lower chamber;

wherein said at least one orifice provides an opening between said lower chamber and an exterior of said cylinder;

wherein said piston comprises a piston head, a piston body, a piston bottom end, and a crosslink receptacle;

wherein said mandrel comprises a mandrel cavity, a first mandrel crosslink slot, and a second mandrel crosslink slot;

wherein said first mandrel crosslink slot and said second mandrel crosslink slot each extend along an axial length of said mandrel;

wherein said sleeve adapter comprises a sleeve adapter cavity, a first sleeve adapter crosslink slot, and a second sleeve adapter crosslink slot;

wherein said assembling step comprises the step of removably fastening a bottom end of said cylinder to a top end of said mandrel;

wherein said assembling step comprises the step of inserting said crosslink through said first sleeve adapter crosslink slot, said second sleeve adapter crosslink slot, said first mandrel crosslink slot, said second mandrel crosslink slot, and said crosslink receptacle to affix said sleeve adapter to said piston and to slidably affix said piston and said sleeve adapter to said mandrel;

wherein said assembling step comprises the step of sliding said piston head into a first position of said lower chamber to create an airtight seal against an inner wall of said lower chamber;

wherein, in said engaging step, said crosslink, said piston, and said sleeve adapter engage in a sliding motion along said axial length and motion of said piston along said axial length results in said piston head moving between said first location in said lower chamber and a second location in said lower chamber.

22. The method of claim 21, wherein said assembling step creates an annular fluid cavity between said piston body and said cylinder wall in said lower chamber, and wherein, in said filling step, annular fluid flows from said casing into said annular fluid cavity.

23. The method of claim 22, wherein, in said engaging step, detonating said setting charge creates said pressure in said upper chamber and said pressure causes said sliding motion.

24. The method of claim 23 wherein, in said engaging step, flow of said annular fluid out of said annular fluid cavity through said at least one orifice causes a resistance against said sliding motion.

25. The method of claim 24, wherein, in said releasing step, said pressure is released through said at least one orifice when said piston head moves to said second location.

26. The method of claim 25, wherein said lower chamber has a first inner diameter at said first location and said lower chamber has a second inner diameter at said second location, wherein said second inner diameter is larger than said first inner diameter, and wherein, in said releasing step, said airtight seal becomes disengaged when said piston head moves to said second location.

27. The method of claim 24, wherein each said at least one orifice is configured to receive an orifice plug and each said orifice plug further comprises an orifice plug tube.

28. The method of claim 27, wherein said assembling step comprises the steps of identifying a desired level of said resistance, installing each said orifice plug in each said at least one orifice, wherein each said orifice plug has an orifice plug tube size selected to achieve said desired level of said resistance.

29. The method of claim 27, wherein said at least one orifice is two orifices and each said orifice plug tube has a diameter of between approximately 0.010 and 0.055 inches.

* * * * *